US011090922B2

(12) United States Patent
Unal et al.

(10) Patent No.: US 11,090,922 B2
(45) Date of Patent: Aug. 17, 2021

(54) THERMAL TRANSFER FOIL FOR PRODUCING A TRUE COLOR IMAGE, PROCESS FOR PRODUCING A TRUE COLOR IMAGE, AND TRUE COLOR IMAGE

(71) Applicant: LEONHARD KURZ Stiftung & Co. KG, Furth (DE)

(72) Inventors: Eser Alper Unal, Furth (DE); Christian Schulz, Furth (DE); Thimo Huber, Bad Kotzting (DE); Norbert Schmidt, Nuremberg (DE); Soren Klages, Furth (DE)

(73) Assignee: LEONHARD KURZ STIFTUNG & CO. KG, Furth (DE)

( * ) Notice: Subject to any disclaimer, the term of this patent is extended or adjusted under 35 U.S.C. 154(b) by 490 days.

(21) Appl. No.: 15/977,307

(22) Filed: May 11, 2018

(65) Prior Publication Data

US 2018/0326718 A1 Nov. 15, 2018

(30) Foreign Application Priority Data

May 12, 2017 (DE) ..... 102017110387.2

(51) Int. Cl.

| | |
|---|---|
| ***B41M 5/385*** | (2006.01) |
| ***B41F 16/00*** | (2006.01) |
| ***B41M 5/382*** | (2006.01) |
| ***B41M 5/025*** | (2006.01) |
| *B41M 5/395* | (2006.01) |

(52) U.S. Cl.

CPC ..... *B41F 16/0013* (2013.01); *B41M 5/0253* (2013.01); *B41M 5/0256* (2013.01); *B41M 5/385* (2013.01); *B41M 5/38228* (2013.01); *B41M 5/38264* (2013.01); *B41M 5/395* (2013.01)

(58) Field of Classification Search

CPC ..... B41M 5/385

USPC ..... 101/488

See application file for complete search history.

(56) References Cited

U.S. PATENT DOCUMENTS

| | | | | |
|---|---|---|---|---|
| 4,744,685 | A * | 5/1988 | Mecke | B41M 5/395 400/241.4 |
| 5,516,590 | A | 5/1996 | Olmstead et al. | |
| 6,504,559 | B1 * | 1/2003 | Newton | B41J 3/4073 347/171 |
| 7,829,162 | B2 | 11/2010 | Eskra et al. | |
| 2004/0247862 | A1 * | 12/2004 | Asajima | B41M 5/38207 428/343 |
| 2008/0090726 | A1 | 4/2008 | Eskra et al. | |
| 2009/0029124 | A1 * | 1/2009 | Washizuka | B41M 3/148 428/207 |
| 2009/0314173 | A1 * | 12/2009 | Nakamura | B41N 1/12 101/395 |
| 2011/0031316 | A1 * | 2/2011 | Morrill-Webb | C09D 11/50 235/488 |

(Continued)

FOREIGN PATENT DOCUMENTS

| | | |
|---|---|---|
| WO | 2008049755 A2 | 5/2008 |
| WO | 2016077169 A1 | 5/2018 |

*Primary Examiner* — Anthony H Nguyen

(74) *Attorney, Agent, or Firm* — Hoffmann & Baron, LLP

(57) ABSTRACT

A thermal transfer foil and also a process for producing a true color image, and a true color image, wherein the thermal transfer foil includes at least one effect pigment layer and a carrier foil which has first effect pigments in one or more first regions.

24 Claims, 10 Drawing Sheets

(56) References Cited

U.S. PATENT DOCUMENTS

| | | | | |
|---|---|---|---|---|
| 2011/0172093 | A1* | 7/2011 | Kazdin | B41M 1/04 503/200 |
| 2012/0225775 | A1 | 9/2012 | Yasumatsu | |
| 2015/0258832 | A1* | 9/2015 | Hsu | B41M 5/385 347/171 |

* cited by examiner

THERMAL TRANSFER FOIL FOR PRODUCING A TRUE COLOR IMAGE, PROCESS FOR PRODUCING A TRUE COLOR IMAGE, AND TRUE COLOR IMAGE

BACKGROUND OF THE INVENTION

The invention relates to a thermal transfer foil for producing a true color image and also to a process for producing a true color image, and to a true color image.

The coating of substrates with effect pigments to provide, to a viewer, particularly bright colors and color effects, especially optically variable effects, dependent on the angle of viewing and/or of illumination, is known practice. This is because effect pigments, when irradiated with white light, are able to act as a kind of spectral filter, reflecting and/or transmitting only a part of the spectrum of the incident white light. In this process, brilliant perceived colors are produced.

A problem affecting this is the print application of varnishes comprising effect pigments by means of digital printing processes such as, for example, xerographic processes or inkjet printing processes. The reason why this presents problems is that the relatively large diameter of the effect pigments to be printed causes clogging in feed lines of the associated printing apparatus. This results in production outages and consequent high financial burdens. Another factor to be considered is the tendency of the effect pigments to settle in the reservoir containers and in the feed lines of the corresponding printers. Depending on the nature and geometry of the effect pigments used, the printing apparatus in question must be adapted to the anticipated deposition tendency of the effect pigments, resulting in a high and incalculable development expenditure.

The problem addressed by the present invention is that of providing an improved process for producing a true color image, and also a thermal transfer film which can be used for this process, and a true color image provided thereby.

SUMMARY OF THE INVENTION

This problem is solved by a thermal transfer foil according to the present invention. This problem is further solved by a process for producing a true color image according to the present invention. This problem is further solved by a true color image according to the present invention.

A feature of a thermal transfer foil of this kind for producing a true color image is that the thermal transfer foil has at least one effect pigment layer and a carrier foil, wherein the effect pigment layer comprises first effect pigments in one or more first regions.

A feature of such a process for producing a true color image is that subareas of an effect pigment layer of a thermal transfer foil, these subareas being formed as halftone dots by means of a thermal transfer printhead, or subareas of effect pigment layers of two or more different thermal transfer foils, these subareas being formed as halftone dots by means of a thermal transfer printhead or of two or more thermal printheads, are applied to a first surface of a substrate to form the true color image.

A feature of such a true color image is that the true color image comprises a multiplicity of halftone dots applied to a first surface of a substrate, wherein the halftone dots are formed by subareas of an effect pigment layer of a thermal transfer foil or by subareas of effect pigment layers of two or more different thermal transfer foils.

Provided as a result is a true color image which offers production-related advantages and, for a viewer, a brilliant perceived color, more particularly a brilliant optically variable perceived color, which is dependent on the viewing angle and/or illumination angle. Hence the invention enables very finely formed halftone dots comprising effect pigments to be applied to a substrate, in an individualized and direct way, on the basis of a print original in electronic or digital form, without a fixedly specified printing form, requiring an extra step of production, such as a printing roll, a printing screen or a printing blanket, for example, in other words by means of "dieless printing" or else "plateless printing", while avoiding the disadvantages outlined above. This means that the thermal transfer printhead is driven directly on the basis of the print original in electronic or digital form, hence allowing the digital printing of effect pigment layers.

In this context it has additionally become apparent, surprisingly, that the size of the individual halftone dots can be chosen substantially independently of the size of the effect pigments used.

Further, investigations have shown that by this means it is also possible to achieve diverse further advantages relative to the application of varnishes comprising effect pigments by means of a printing process, such as inkjet printing in particular: it is possible, accordingly, to design the distribution of the pigments within the halftone dot, and also, moreover, the alignment of the effect pigments and/or the distribution of the alignment of the effect pigments, in a predefined way and differently from one halftone dot to another, something which is not possible with application in a liquid medium. As a result it is possible to achieve numerous innovative optical effects.

It has also emerged, moreover, that by corresponding application, above and alongside one another, of such halftone dots, comprising different effect pigments, different distribution of effect pigments and/or different alignment of effect pigments through corresponding additive and subtractive color mixing, and also optical superimposition of the effects, it is possible to generate complex, optically variable, multicolored images.

Advantageous refinements of the invention are designated in the dependent claims.

The first region of the effect pigment layer comprises preferably at least 90% of the area of the effect pigment layer and/or of the area of the carrier foil. This is especially advantageous if the thermal transfer foil is used in a thermal printing process which is designed for a high throughput. With such processes it is an advantage if a plurality of thermal transfer foils are employed and if the individual thermal transfer foils each exhibit a uniform optical effect over the whole area. Hence in this regard it may also be possible and advantageous if the first region of the effect pigment layer occupies the entire area of the effect pigment layer and/or the area of the carrier foil. In this connection, moreover, it is also possible, however, for the first region of the effect pigment layer to comprise subregions in which the first effect pigments are disposed in different particle area density and/or alignment, and which therefore are distinguished by a different optical effect.

According to a further variant embodiment, the effect pigment layer may comprise second effect pigments in one or more second regions and/or third effect pigments in one or more third regions and/or fourth effect pigments in one or more fourth regions. In this case the first, second, third and/or fourth effect pigments may differ in respect of their optical effect, more particularly in respect of their color effect and/or orientation. The first, second, third and/or fourth regions may be disposed alongside one another with respect to the plane defined by the effect pigment layer.

Alongside one another here may mean that the first, second, third and/or fourth regions may be directly adjacent to one another or else may be disposed with a spacing or gap between them. It is possible for the first, second, third and/or fourth regions to be disposed in an iterative sequence in relation to the longitudinal extent of the effect pigment layer. Thus, for example, an effect pigment layer may have first, second and third regions lying alongside one another and repeating in this sequence along a direction.

Transfer foils of these kinds bring advantages especially when using thermal transfer printing processes which are designed for a low print throughput. Hence it is possible, by using one or just a few thermal transfer foil(s), to achieve large color spaces and diverse optically variable effects and hence also to produce individual images or small runs of an individual image at very favorable cost.

The total area of the first, second, third and/or fourth regions comprises in each case at least 25% of the area of the effect pigment layer and/or of the area of the carrier foil.

The particle area density of the first, second, third and/or fourth effect pigments is preferably substantially constant over the respective first, second, third and fourth regions. The advantage this produces is that the true color image produced by thermal transfer printing is a particularly faithful reproduction of the print original; in other words, the homogeneous or consistent properties of the effect pigments, achieved as a result, make it possible to achieve a similarly homogeneous or consistent quality in the optical effects.

By "particle area density" is meant the number of first, second, third and/or fourth effect pigments or the number of pigments per unit area in an area-like region which can have a defined layer thickness. The particle area density of the respective effect pigments may also exhibit statistical fluctuations over the respective first, second, third and/or fourth regions. A substantially constant particle area density therefore refers also to a particle area density distribution in the region in question that is present with a standard deviation of less than 30%, more particularly less than 20%, more preferably less than 10%.

The particle area density of the first, second, third and/or fourth effect pigments in the first, second, third and/or fourth regions, respectively, is between 30% and 100%, more particularly between 50% and 100%, preferably between 70% and 100%.

In this context it is also possible for the particle area density in which the effect pigments are present in the respective first, second, third and fourth regions to be different. Thus, for example, the first region or the first regions has or have a first particle area density, the second region or second regions have a second particle area density, and so on, this density being individually selected, so that, for example, the first particle area density differs from the second particle area density.

The alignment of the first, second, third and/or fourth effect pigments over the respective first, second, third and fourth regions, respectively, is preferably substantially constant or else in particular exhibits a statistical variation about a substantially constant mean alignment. Preferably in this case both the mean alignment and the distribution of the alignment are substantially constant over the respective first, second, third and/or fourth regions. The advantage this produces is that particularly faithful reproductions—that is, reproductions formed with homogeneous or consistent quality of the optical effects—of an original image can be produced and, additionally, that a multiplicity of optically variable effects can be realized by means of thermal transfer printing.

The alignment of an effect pigment refers to the surface normal on the sectional plane by the effect pigment, which is distinguished by the maximum size of area relative to the other sectional planes of the effect pigment. In the case of platelet-shaped effect pigments, therefore, this sectional plane is defined by the sectional plane parallel to the major surfaces of the platelet.

A substantially constant alignment means an alignment wherein the alignment of the respective effect pigments over the respective range varies by not more than 30°, preferably not more than 20°, more preferably by not more than 10°.

A substantially constant mean alignment refers to an alignment wherein the respective alignments of the effect pigments of a surface region vary by not more than 15°, more particularly by not more than 10°, preferably by not more than 5°, relative to the corresponding mean alignment of the effect pigments of the surface region.

A substantially constant alignment may also be understood, furthermore, to refer to an alignment wherein the statistical distribution of the alignment about a mean alignment exhibits a standard deviation of less than 15%, preferably of less than 10%, more preferably of less than 5%.

A substantially constant statistical variation of the alignment about a mean alignment refers to a statistical variation whose standard deviations differ by not more than 10%.

It is advantageous, furthermore, if the alignment, the mean alignment and/or the distribution of the alignment of the effect pigments differs in the first, second and third and/or fourth regions, preferably by more than 15%. By this means it is possible to realize interesting optically variable effects by means of thermal transfer printing, since the slightly different alignment of the effect pigments to one another can lead to a different visual appearance or to a different optical effect for each differently aligned effect pigment, and this may be advantageous for particular optical effects, such as a slight glitter effect, for example.

The carrier foil consists preferably of PET (PET=polyethylene terephthalate). The carrier foil preferably has a layer thickness of between 3 μm and 30 μm, more particularly between 3 μm and 15 μm. Hence the layer thickness of the carrier foil may for example be 5.7 μm. A carrier foil of this kind is especially flexible. It is also conceivable, moreover, for the carrier foil to be stretchable and/or to be able to be rolled up. The layer thickness and/or the material of the carrier foil are preferably made such that the carrier foil passes sufficient heat sufficiently quickly during thermal transfer printing from the thermal transfer printhead to the layers that are to be transferred onto the substrate.

The effect pigment layer is produced on the carrier foil preferably by means of a decorative varnish, using a coating process such as gravure, flexographic or screen printing. The decorative varnish preferably comprises one or more binders of the following classes of compound: polyacrylate, polyurethane, polyvinyl chloride, polyvinyl acetate, polyester, polystyrene, and copolymers of the aforesaid classes of compound. The decorative varnish consists, moreover, of one or more solvents in which the binders are in solution. These solvents may be, for example, ketones such as acetone, cyclohexanone or methyl ethyl ketone. Furthermore, these solvents may be esters, such as ethyl acetate, butyl acetate and others, for example. The solvents, furthermore, may be hydrocarbons such as toluene, mineral spirit, etc., for example. Also conceivable are alcohols, such as ethanol, 2-propanol, 1-propanol or 1-butanol. Likewise conceivable is the use of an aqueous dispersion or emulsion. The first, second, third and/or fourth effect pigments are preferably embedded into the corresponding binder. More particularly up to 80 weight percent (weight percent=fraction of the weight in percent based on the total weight) of the solids of the effect pigment layer consist of the respective first, second, third and/or fourth effect pigments or mixtures thereof. In such a case it is also said that the fill level of the effect pigments in the solids present as effect pigment layer is up to 80 weight percent. A further possible component provided in the effect pigment layer is a rheological additive.

In this case the rheological additive may in particular consist of a phyllosilicate, as for example of a bentonite. The rheological additive may suppress or prevent the deposition and/or the settlement and/or the compacting of the effect pigments. In this context the rheological additive is also said to suppress or prevent sedimentation of the effect pigments.

The sedimentation of effect pigments in a liquid medium, such as a solution of the above binders in the aforementioned solvents, for example, is a frequently encountered and significant technical problem which must be solved by a suitable formulation, in other words a suitable composition, of decorative varnishes in order to prevent decorative-varnish feed lines or decorative-varnish reservoir vessels becoming clogged. Hence the size and/or the shape and/or the high density, particularly in comparison to that of the above binders, of the effect pigments as solids in the liquid binders leads to rapid settlement and/or rapid sedimentation in relation to the period spent by the decorative varnish in the corresponding feed lines or reservoir vessels. Accordingly, in the case of white pigments which may have a spherical shape and/or a diameter of less than 5 μm, more particularly of less than 1 μm, the problem of settlement and/or of sedimentation is not very great, in contrast to the first, second, third and/or fourth effect pigments as constituent parts of the decorative varnish of the effect-pigment pigment layer.

The settlement rate of effect pigments contained in the decorative varnish may be dependent not only on the size, shape and/or density but also, or exclusively, on the viscosity and/or polarity of the binder and/or of the rheological additive. The settlement time of the effect pigments may be in the range from a few days down to a few hours. Another solution to this problem is to maintain the decorative varnish in motion by stirring and/or shaking, so that the effect pigments it contains do not settle. A combination of shaking and/or stirring of the decorative varnish and the addition of one or more of the above rheological additives, more particularly phyllosilicates and/or bentonites, is also conceivable. Phyllosilicates and/or bentonites are particularly advantageous rheological additives since they keep any possible precipitate of the effect pigments soft and in a bulky form, allowing such an effect pigment precipitate to be dissolved again by stirring and/or shaking.

It is particularly advantageous if the effect pigment layer also provides the functions, additionally, of a primer layer and/or adhesive layer. By virtue of this it is first no longer necessary for the thermal transfer foil to possess a corresponding additional primer layer or adhesive layer which ensures the attachment of the effect pigment layer after application to the substrate. Furthermore, it has also emerged that by corresponding design of the effect pigment layer it is possible for an improved optical result to occur (and also that the anti-counterfeit security can be improved, since detachment of the applied halftone dots without loss of the optical information is made more difficult.

In order to enable this dual function on the part of the effect pigment layer, it has proven to be advantageous to add corresponding binders to the effect pigment layer that are activatable and/or curable by heat and/or UV radiation. It is possible for the activation to be generated or initiated in particular as well by a crosslinking reaction in the binder of the effect pigment layer. The adhesive layer thus formed by the effect pigment layer thus constitutes an adhesive layer which more particularly is an adhesive layer curable and/or activatable by heat and/or UV radiation (UV radiation=electromagnetic radiation from the ultra-violet part of the spectrum of electromagnetic radiation or from one or more sub-regions of the ultraviolet part of the spectrum of electromagnetic radiation). Additional curing of the binder of the effect pigment layer may be accomplished preferably by UV radiation in an operating step (post-curing) taking place after, in terms of time, the activation by means of heat.

Moreover, the effect pigment layer may additionally have one or more primer layers and/or adhesive layers on the side of the effect pigment layer that faces away from the carrier foil.

The decorative varnish for forming the effect pigment layer on the carrier foil of the thermal transfer foil is preferably applied by means of a printing process, more particularly by means of a gravure, screen, flexographic, offset or pad printing process, to the carrier foil. The decorative varnish in this case may more particularly comprise an organic solvent or binder, or be water-based.

Additionally, a detachment layer may be disposed between the effect pigment layer and the carrier foil of the thermal transfer foil, and the detachment layer may be applied to the carrier foil by means of a printing process, more particularly by means of a gravure, screen, offset or pad printing process. The detachment layer more particularly consists entirely or partly of a resin, preferably a silicone resin, and at least one binder, more particularly an acrylate, and/or of one or more waxes. The layer thickness of the detachment layer is preferably in a range between 0.1 μm and 3 μm, more particularly between 0.25 μm and 0.75 μm.

The layer thickness of the effect pigment layer is between 0.5 μm and 5 μm, more particularly between 1 μm and 3 μm, preferably between 1.5 μm and 2.5 μm. The effect pigment layer may be provided, for example, with a layer thickness of 2 μm, with the above layer thickness providing more particularly an optimum in terms of a desired decoration effect of the effect pigment layer and of cleanliness of printing. While larger layer thicknesses of the effect pigment layer, more than 2.5 μm, do have a greater optical brightness effect and/or produce a color effect or a color change effect that is stronger as detectable to a viewer, by comparison with effect pigment layers having layer thicknesses of less than 1.0 μm, they also have greater uncleanliness in the application of the effect pigment layer during subsequent thermal transfer printing, particularly in the form of halftone dots.

The effect pigment layer, further, may additionally comprise absorbing inorganic and/or organic dyes and/or pigments, in each case providing the color of the dyes and/or pigments through absorption of a partial spectrum of the incident light. The weight fraction of absorbing pigments among the entirety of the pigments in this case is preferably below 20%, more particularly below 5%, preferably below 1%.

By an effect pigment is meant, preferably, an interference pigment of any desired form which is preferably transparent and platelet-shaped and more particularly has at least one interference layer.

"Platelet-shaped" refers to a body whose two largest surfaces are disposed substantially parallel to one another.

Hence a platelet-shaped effect pigment may be distinguished in particular by the fact that the two largest opposite surfaces of an effect pigment are aligned in parallel to one another.

In the case of a transparent effect pigment, a first part of the light incident on an effect pigment is reflected by the effect pigment, and a second part of the incident light is transmitted by the effect pigment, with preferably only a negligible part of the incident light being absorbed.

"Transparent" here refers preferably to transmission in the visible wavelength range of more than 50%, preferably of more than 80%, and more preferably of more than 90%.

One or more layers or components of the effect pigment may also, however, be semi-transparent. In this case in particular a non-negligible part of the incident radiation or incident light is absorbed.

"Semi-transparent" refers here to a transmissivity in the visible wavelength range of between 10% and 70%, more preferably between 10% and 50%.

An "interference pigment" here means a pigment which generates optical effects by means of interference of the light impinging on the pigment and reflected again and/or transmitted. Thus, for example, interference pigments may act as interference color filters and in so doing may generate one or more colors, more particularly colors different from one another, in transmission and/or reflection. With particular preference the interference pigments in this case give rise to a color shift effect in the visible wavelength range that is dependent on the viewing angle or on the angle of light incidence.

Non-transparent effect pigments are, for example, effect pigments which have non-transparent layers, especially metal layers, consisting for example of aluminum or of opaque color pigments. Metallic effect pigments in particular do produce strong interference effects and/or color effects, but are not transparent.

Preferably one or more, or all, of the first, second, third and/or fourth effect pigments are transparent or semi-transparent.

Moreover, effect pigments preferably have an auxiliary carrier, more particularly a platelet-shaped auxiliary carrier. In this case the auxiliary carrier has at least one interference layer at least on one side. The auxiliary carrier is preferably surrounded comprehensively by one or more interference layers, in which case the interference layers may be disposed alongside one another and/or above one another. At the interface between the auxiliary carrier and one or more of the interference layers, it is possible for at least one first auxiliary layer to be disposed. The one or more sides and/or surfaces that face away from the auxiliary carrier preferably have at least one second auxiliary layer.

The layer thickness, especially the average layer thickness, of the at least one auxiliary carrier is between 100 nm and 2000 nm, more particularly between 300 nm and 700 nm. The auxiliary carrier, which increases the mechanical robustness of the effect pigment in question, consists preferably of one or more of the following substances: natural mica, synthetic mica, aluminum oxide $Al_2O_3$, silicon dioxide $SiO_2$, borosilicate glass, nickel, cobalt. The at least one first auxiliary layer consists preferably of tin oxide $SnO_2$ and acts in particular as a crystallization aid in the formation of the metal oxide layer and/or the interference layer. The at least one second auxiliary layer acts as a protective layer against chemical and/or physical interactions with the environment of the respective first, second, third and/or fourth effect pigment.

The layer thickness of the at least one interference layer is between 50 nm and 500 nm, more particularly between 70 nm and 250 nm, and the interference layer consists preferably of one or more metal oxides, metal halides or metal sulfides, etc. Selection may be made here, for example, from iron oxide $Fe_2O_3$, zinc sulfide ZnS, silicon oxide $SiO_2$, titanium dioxide $TiO_2$, especially in the rutile modification, but also in the anatase modification or in the brookite modification, and/or magnesium fluoride $MgF_2$.

One or more of the interference layers of an effect pigment may provide interference effects, such as color change effects, for example, under incident light. These interference effects are generated in this case by the path differences for the incident light that are provided by the one or more interference layers. In particular, the color change effects based on interferences at the metal oxide/binder and/or auxiliary carrier/metal oxide boundary layers exhibit a dependence on the viewing angle and/or illumination angle of the incident light. Hence a part of the spectrum of the incident light is extinguished by destructive interference, and conversely another part of the spectrum of the incident light is boosted by constructive interference. This effect provides a color effect for an observer on reflection of the incident light at the interference layer of the effect pigment in question. For color effects or color change effects of this kind, preference is given to forming the interference layers of the effect pigments using materials which in particular have a refractive index $n_D$ greater than that of air. In this case, preferably, one or more of the following materials are used: $MgF_2$ ($n_D$=1.38), $SiO_2$($n_D$=1.42 to 1.47), rutile or $TiO_2$ ($n_D$=2.6 to 2.9). The interference layer more particularly has a refractive index of between 1.2 and 4.0, more particularly between 1.38 and 2.9.

One or more, or all, of the first, second, third and/or fourth effect pigments may be selected from the following: red interference pigments, green interference pigments, blue interference pigments, white interference pigments, white effect pigments, black effect pigments. Here, "red", "green", "blue", "white" and "black" denote the color effects of the correspondingly assigned effect pigments and/or interference pigments under incident light, especially white light, for the average human eye of a viewer.

Further, one or more, or all, of the first, second, third and/or fourth effect pigments may have a spherical, platelet-like, cubic, cuboidal, toroidal, discoid, lumplike or irregular shape, with the white effect pigments having in particular a spherical shape with a diameter of preferably less than 5 μm, more particularly less than 1 μm. Here, one or more, or all, of the first, second, third and/or fourth effect pigments have a smallest diameter, more particularly a mean smallest diameter, which in particular is less than 5 μm, preferably less than 2 μm.

One or more, or all, first, second, third and/or fourth effect pigments may have a largest diameter, more particularly an average largest diameter, which is between 2 μm and 200 μm, more particularly between 5 μrn and 35 μm. In the case of an ellipsoid-shaped effect pigment, which has three semi-axes a, b and c which are different sizes from one another, so that, for example, a>b>c, the semi-axis a would correspond to the largest diameter of the effect pigment, and the semi-axis c to the smallest diameter of the effect pigment.

The use of transparent or semi-transparent effect pigments has proven advantageous here since the low absorption or lack of absorption of the incident light, and the optical effects which also occur, furthermore, in transmission, make it possible for particularly bright colors and the color mixing effects to be achieved. This is also the case, moreover, using both effects, namely the optical effect in reflection and transmission.

The size of the first, second, third and/or fourth effect pigments in the respective first, second and/or third regions is preferably substantially constant or has a substantially constant effect pigment size distribution.

The effect pigment size distribution of the effect pigments in the effect pigment layer, and especially in the first, second, third and/or fourth regions, is preferably selected as follows:

The value of the 50% quantile of the effect pigment size distribution divides the effect pigment size distribution in such a way that 50% of the values of the effect pigment size distribution lie below the value of the 50% quantile and the remaining 50% of the values of the effect pigment size distribution lie above the value of the 50% quantile. Instead of a 50% quantile it is possible to select any desired quantile, such as the 90% quantile or the 10% quantile, for example. The 50% quantile is also often designated $D_{50}$. $D_{50}$ may also indicate the average effect pigment size. $D_{50}$ means that 50% of the effect pigment sizes are smaller than the stated value. Further important parameters are $D_{10}$, as a measure of the smallest effect pigment sizes (10% of the particles are smaller than the stated value), and $D_{90}$ (90% of the particles are smaller than the stated value). The closer together $D_{10}$ and $D_{90}$ are, the narrower the effect pigment size distribution, and vice-versa.

The 90% quantile of the effect pigment size distribution here is preferably less than 35 μm and/or the 50% quantile of the effect pigment size distribution is preferably less than 20 μm and/or the 10% quantile of the effect pigment size distribution is preferably less than 12 μm. Preferably 35% to 45% of the effect pigment sizes are in a range between 6 μm and 20 μm, more particularly between 10 μm and 18 μm.

Investigations have shown that through the above-cited selection of the effect pigment sizes and their distribution, the optical effect of the applied halftone dots is manifested particularly well.

Advantageously it is possible for one or more, or all, of the first, second, third and/or fourth effect pigments to have a first perceived color in reflected light, more particularly in reflected light with white light, and to provide a different perceived color, as for example a second perceived color complementary to the first perceived color, in transmitted light, in particular. The complementary perceived color in transmitted light is generated by virtue of the fact that the effect pigment reflects a certain part or region of the spectrum of the incident light at the air/interference layer and/or interference layer/auxiliary carrier interfaces and is unable to transmit this part of the spectrum through the effect pigment. In the case of a plurality of interference layers, the incident light may also be reflected at the interference layer/interference layer interfaces, in which case the number of interference layer/interference layer interfaces is the number of interference layers minus one.

For example, an effect pigment in reflected light, on incidence of white light, may extinguish in reflection all colors or spectral components of the spectrum of the incident white light apart from the color green, so that a viewer in reflected light perceives a green-colored effect pigment. If the viewer views the effect pigment in transmitted light, the viewer will perceive the color complementary to this, in other words red to magenta. The remaining wavelength ranges of the originally white light are extinguished by destructive interferences within the layer structure of the effect pigment.

Furthermore, the side and/or surface of the carrier foil that faces away from the effect pigment layer may have a backside coating, more particularly a lubricious backside coating, since the surface or the surfaces of the carrier foil often does or do not have sufficient lubricity to allow the sliding of the thermal transfer printhead over the carrier foil.

The backside coating may be applied by means of a printing process, more particularly by means of a gravure, screen, flexographic, offset, inkjet or pad printing process, to the carrier foil and/or to the side and/or surface of the carrier foil that face away from the effect pigment layer. The backside coating preferably comprises one or more polyester resins or consists of one or more polyester resins. Besides the components stated, the backside coating may further comprise one or more solvents, examples being organic solvents, which evaporate after coating. It is also possible, moreover, for the backside coating to be a water-based coating. The backside coating may in particular comprise one or else two or more layers of identical or else different coating materials. The backside coating preferably comprises one or more polyester resins or consists of one or more polyester resins. The layer thickness of the backside coating is preferably in a range from greater than or equal to 0.05 μm to less than or equal to 3 μm, more particularly of greater than or equal to 0.2 μm to less than or equal to 0.8 μm, and the coatweight of the backside coating is preferably in a range from greater than or equal to 0.05 $g/m^2$ to less than or equal to 3 $g/m^2$, preferably from greater than or equal to 0.2 $g/m^2$ to less than or equal to 0.8 $g/m^2$.

The true color image may consist of a multiplicity of true color domains which exhibit an assigned true color when illuminated in reflected light viewing and/or transmitted light viewing.

True color here refers to a color which may be formed in particular by color mixing from one or more spectral colors. A true color image and a true color domain exhibit at least one true color on illumination.

The true color domains of the true color image here preferably possess lateral extents of between 400 μm and 50 μm. Preferably both lateral dimensions are selected in the range between 300 μm and 50 μm and hence amount in particular to 300 μm, 250 μm or 200 μm. The size of the color domain here is preferably selected such that the color domain lies at the resolution limit of the human eye for the viewing distance selected, and accordingly the color domain is perceived on the part of the human viewer as a color or color range which cannot be further resolved.

Preferably in at least 10% of the true color domains, more preferably in more than 40% of the true color domains, two or more halftone dots are applied by means of the thermal transfer printhead or the thermal printheads. These two or more halftone dots are formed here by subareas of effect pigment layers, which differ in respect of the optical effect and/or orientation of their effect pigments. These halftone dots are applied here in such a way that the assigned true color is generated on illumination by additive and/or subtractive color mixing of these halftone dots applied in the respective true color domain.

Preferably, in each of the true color domains, two or more of the halftone dots are applied alongside one another and/or over one another and/or overlapping one another on the first surface of the substrate. The true color image therefore preferably has color domains in which two or more halftone dots have been applied alongside one another and/or partially and/or completely above one another and/or overlappingly. These halftone dots may be formed by subareas of one and the same effect pigment layer of a thermal transfer foil, and/or by subareas of effect pigment layers of different thermal transfer foils. Further, these halftone dots may be formed by subareas of one or different effect pigment layers which have different effect pigments, a different alignment of the effect pigments and/or a different area density of effect pigments. The corresponding disposition of two or more halftone dots in the respective true color domain, owing to the resultant optical superimposition of the optical effects generated by the halftone dots in the respective true color domain, preferably produces a correspondingly individualized integrative optical effect for the human viewer. Depending on the effect pigments used, their alignment and area density, and also on the nature of application over one another, alongside one another or overlappingly, there are additive and/or subtractive color mixing effects and there is also a specific appearance image dependent on the viewing angle. Accordingly, by means of this embodiment, it is possible to construct true color images from such true color domains which on the one hand cover a broad color space and, moreover which also possess an individual, complexly selected optically variable appearance.

The halftone dots preferably have at least one lateral dimension in the range of between 40 μm and 100 μm, with the lateral dimensions of the halftone dots amounting preferably to between two times and five times the lateral dimension of the effect pigments.

Investigations have shown that in the choice of a halftone dot size of this kind there is a good compromise between the fineness of the halftone dot and also the brightness of the optical effect generated by the respective halftone dot.

For the production of the true color image, the following steps are preferably carried out:

First of all a preferably opaque motif, more particularly in digital form, is provided.

The motif for conversion as a true color image may have any desired form. The process can be used for both multicolor motifs and single-color motifs. A single-color or multicolor motif, or one or more parts of a single-color or multicolor motif, may be composed in particular of photos, images, alphanumeric symbols, logos, microtexts, portraits and/or pictograms. Any desired digital originals may be selected for one or more motifs. For example, an original for a motif may be provided as an image file in PNG format (PNG=Portable Network Graphics) or JPEG format (JPEG=Joint Photographic Expert Group) or FITS format (FITS=Flexible Image Transport System) or TIFF format (TIFF=Tagged Image File Format). In this case it is advantageous that the original for a motif has at least the same resolution as the motif printed as a true color image. A better quality can be provided for the true color image if the resolution of the original of a motif is greater, in particular twice as great, as the motif printed as a true color motif.

Two or more color channels are subsequently selected in the digital original of the motif, and the grayscale image assigned to the respective color channels is determined. For example, a first grayscale image assigned to a red color channel, a second grayscale image assigned to a green color channel, and a third grayscale image assigned to a blue color channel are determined.

A "grayscale image" here means an image which assigns the respective color value, in the form of a corresponding gray value or brightness value of the assigned color channel, to the respective pixels of the motif.

Division into the color channels, or the choice of the color channels, takes place here as a function of the effect pigments provided in each case in the effect pigment layer or layers of the thermal transfer foils or foil, and also of their effect in reflection and/or in transmission—in other words, whether in this case color mixing is to be achieved by additive color mixing, subtractive color mixing, and also additive and subtractive color mixing.

It is also possible, furthermore, if in each case two or more color channels are determined for different space regions of the observation space of the color image. This is especially advantageous when, in the effect pigment layer or effect pigment layers, there are regions provided in which the effect pigments possess a different spatial alignment or distribution of the alignment and hence possess correspondingly different optical effects in the selected space regions.

The respective grayscale images are subsequently converted by means of corresponding algorithms and calculation methods, as for example by means of a RIP (RIP=Raster Image Processor) designed especially for that purpose, into a respective raster image consisting of a multiplicity of halftone dots. This is done preferably on the basis of a frequency-modulated raster and/or a period-modulated and/or amplitude-modulated raster.

Subsequently the thermal transfer printhead or the thermal transfer printheads is or are driven in such a way that the subareas of the effect pigment layer, formed as halftone dots, are transferred in accordance with the size and arrangement of the halftone dots of the raster images onto the first surface of the substrate.

In this case, preferably, each of the grayscale images or color channels is assigned a thermal transfer foil or a region of a thermal transfer foil; for example, a first grayscale image is assigned the first region and/or regions, the second grayscale image is assigned the second region or regions, the third grayscale image is assigned the third region or regions, and/or the fourth grayscale image is assigned the fourth region or regions, as specified above.

The raster images are preferably provided on the basis of periodic rastering with two or more different screen angles and/or two or more different halftone dot shapes.

The halftone dot shapes are preferably selected from the following: punctiform, rhomboidal, cruciform. It is, however, also possible to use differently shaped halftone dot shapes.

The screen width of the rastering is preferably selected in the range between 35 lpi and 70 lpi.

A thermoplastic substrate, such as PVC, PET, PP, PE, PA or PEN, for example, is used advantageously for the thermal transfer printing. Paper and cardboard systems likewise constitute advantageous substrates for the thermal transfer printing described here. Moreover, the use of woven fabrics with synthetic, natural or else blended fibers has also been found to be advantageous for the substrate. The composition of the substrate is selected such that the thermal transfer foil adheres on the substrate following application, in particular by means of thermal transfer printing.

The substrate provided may be a transparent substrate, so that incident light is able to be transmitted through the substrate, in which case the transparent substrate is applied in particular by the surface opposite the first surface to a dark or black background, more particularly to a colored background.

It is also possible, moreover, for the thermal transfer printing to take place mirror-invertedly onto the transparent substrate. A preferably black/dark background is subsequently applied to the printed side of the transparent substrate. In this way the transparent substrate protects the printing provided between the transparent substrate and the black background.

It has proven advantageous for a black and/or dark and/or opaque substrate and/or a surface of a black and/or dark and/or opaque substrate to be printed with a thermal transfer foil in particular by means of thermal transfer printing. "Opaque" here means in particular that no light or only a negligible quantity of light is transmitted through an opaque material.

It has emerged that strongly reflecting substrates in particular, especially pale and/or white substrates, which are printed with the thermal transfer foil comprising first, second, third and/or fourth effect pigments, reduce the color effect of the effect pigments. This means that the color effects and/or color shift effects of the effect pigments printed onto a white and/or pale substrate can be detected less easily for a viewer than if a black and/or dark and/or opaque substrate is used.

Moreover, on the first surface and/or on the surface of the substrate opposite to the first surface, there may be one or more protective layers applied, in which case one or more of the protective layers may be selected exclusively and/or in combinations from the following: transparent overprint, laminate, plastic sheet, glass sheet.

Furthermore, the substrate may have, on a second surface opposite the first surface of the substrate, a ground, where the ground is formed of at least one colored varnish coat. The color value of the visible intrinsic color of the at least one colored varnish coat in a color space defined by coordinate axes a* and b* specifying the complementary colors and by coordinate axis L* specifying the luminance of the hue, more particularly in a CIELAB color space, can be provided in a range of L* of greater than or equal to 0 and less than or equal to 90.

Advantageously, the colored varnish coat may comprise one or more dyes and/or one or more pigments, more particularly one or more different-colored pigments, wherein one or more of the pigments are selected in particular from the following: optically variable pigments, especially pigments containing thin-film layers and/or liquid-crystal layers which generate a color shift effect dependent on viewing angle or illumination angle, organic pigments, inorganic pigments, luminescent additives, UV-fluorescent additives, UV-phosphorescent additives, IR-phosphorescent additives, IR upconverters, thermochromic additives. IR upconverters selected are preferably additives which shine in particular in the visible wavelength range of light when they are exposed to infrared radiation.

In the case of use of pigments in the at least one colored varnish coat, it has proven useful to determine the pigmentation by means of a pigmentation number PN, which lies preferably in a range of greater than or equal to 1.5 $cm^3/g$ and less than or equal to 120 $cm^3/g$, more particularly greater than or equal to 5 $cm^3/g$ and less than or equal to 120 $cm^3/g$. The pigmentation number may be defined by way of the following equations:

$$PN = \sum_{1}^{x} \frac{(m_P \times f)_x}{(m_{BM} + m_A)} \text{ and } f = \frac{ON}{d},$$

where:

$m_P$=mass of a pigment in the colored varnish coat, in grams, $m_{BM}$=preferably constant; mass of a binder in the colored varnish coat, in grams, $m_A$=preferably constant; mass of solids of the additives in the colored varnish coat, in grams, ON=oil number of a pigment, particularly according to DIN 53199, d=density of a pigment, particularly according to DIN 53193, x=running variable, corresponding to the number of different pigments in the colored varnish coat.

In particular it is also possible, before and/or else after application of the true color image to the substrate, to apply further layers or layer sequences to the substrate, these layers or layer sequences in particular jointly representing an overall motif with the motif of the true color image. The further layers or layer sequences may likewise be applied by means of thermal transfer foils or else by means of other processes such as, for example, gravure, flexographic, screen, pad or inkjet printing, hot stamping, cold stamping or other known processes, to the substrate.

The further layers or layer sequences may for example take the form of transparent and/or translucent and/or opaque color layers, transparent and/or translucent and/or opaque metallic layers (applied by vapor deposition and/or sputtering and/or printing), an open or embedded replication layer with diffractive and/or refractive relief structures, more particularly with a transparent and/or translucent and/or opaque reflection layer disposed thereon in the form of a thin metal layer and/or an HRI layer with high refractive index (HRI=High Refractive Index) and/or as an LRI layer with a low refractive index (LRI=Low Refractive Index), a volume hologram, a transparent and/or translucent and/or opaque thin-film construction, particularly according to Fabry-Perot with absorption layer, spacer layer and reflection layer, or other known layers or layer sequences.

By means of such layers applied before and/or after the application of the effect pigment layer it is possible, for example, for individual subregions of the true color image to be emphasized with accentuation or else attenuated. For example, contours or subareas of the true color image may be given correspondingly different designs in this way. The true color image, for example, may be embedded or inserted into an overall motif and/or into an overall pattern by means of such layers applied before and/or after, so that the true color image is disposed adjacently to the layers applied before and/or after.

The register tolerance in a first and/or a second direction, preferably the advancement direction of the thermal transfer foil and/or of the substrate, and/or in a direction perpendicular to the advancement direction, between the true color image and the further layers or layer sequences, is here approximately ±0.15 mm, preferably in the ±0.05 mm to ±0.5 mm range.

The invention is elucidated by way of example below, using a number of exemplary embodiments.

BRIEF DESCRIPTION OF THE DRAWINGS

FIG. 1 shows the layer construction of a thermal transfer foil 1 in principle.

Figure 1:
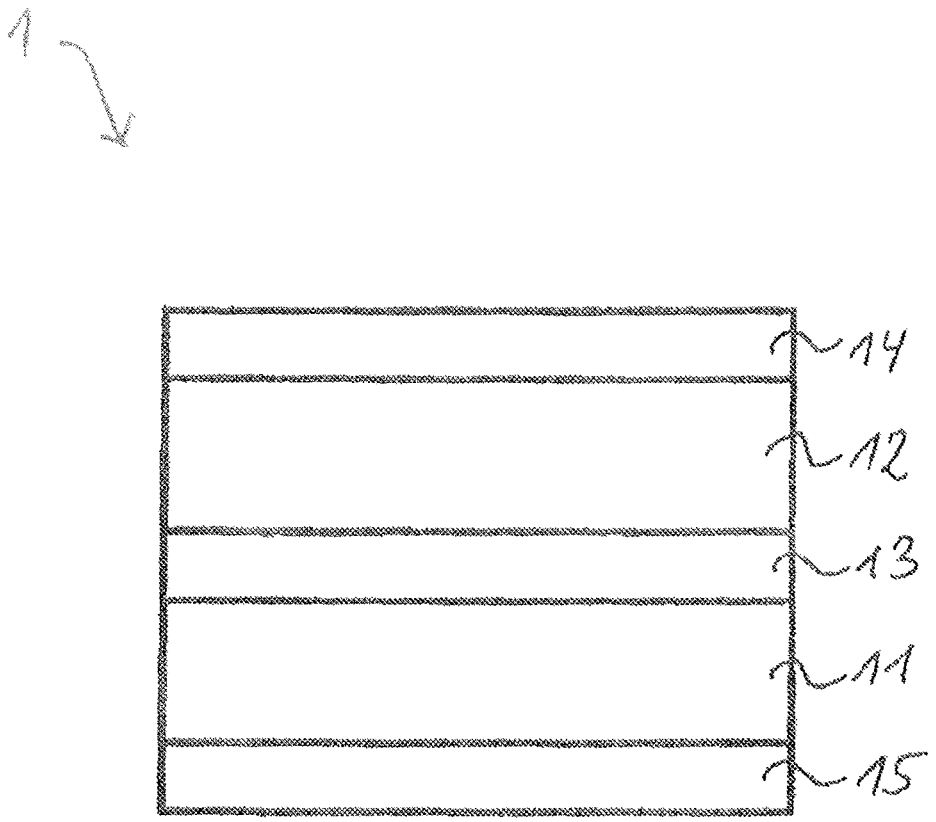
FIG. 1 shows a schematic representation of a thermal transfer foil

The thermal transfer foil 1 comprises a carrier foil 12 and an effect pigment layer 11. This thermal transfer foil 1 is designed, in terms of its layer construction and the design of the individual layers, in such a way that the effect pigment layer 11 can be applied regionally to a surface of a substrate by means of a thermal transfer process and more particularly by means of a thermal transfer printhead. For this purpose it is necessary for regions of the effect pigment layer 11 to be detachable from the transfer foil 12 on local introduction of heat by means of a thermal transfer printhead and adhered on the surface of the substrate correspondingly as mediated by the heat.

For this purpose, the thermal transfer foil 1 is formed preferably as described below:

The thermal transfer foil 1, in addition to the carrier foil 12, preferably has a backside coating 14, a detachment layer 13 and an adhesive layer 15.

The carrier foil 12 consists preferably of a polymeric foil in a layer thickness of between 3 μm and 30 μm. It has proven particularly appropriate to use a PET foil for the carrier foil 12, and more particularly to use a PET foil in a layer thickness of between 3 and 15 μm, 5.7 μm for example. This choice of the layer thickness of the carrier foil 12 ensures that sufficient heat can be transported from the printhead through the carrier foil 12 in order to allow the subsequent layer to be transferred to the surface of the substrate.

Particularly advantageous here, moreover, is the use of the backside coating 14. This is the case because the surface of customary plastic carrier foils is frequently too rough or too dull to glide sufficiently well over the printhead of the thermal transfer printer. The backside coating 14 hence consists preferably of a lubricious coating material which is applied preferably with a layer thickness of between 0.05 μm and 3 μm, in particular approximately 0.3 μm, to the carrier foil 12. The backside coating 14 is here applied preferably by gravure printing. The backside coating 14 preferably comprises one or more polyester resins or consists of one or more polyester resins.

The optionally provided detachment layer 13 improves the detachment property of the effect pigment layer 11 from the carrier foil 12 during thermal transfer printing. The detachment layer 13 preferably has a layer thickness of between 0.1 μm and 3 μm, more preferably between 0.25 μm and 0.75 μm. The detachment layer 13 here consists preferably of a resin, more particularly a silicone resin, with a binder, more particularly an acrylate. Further, the detachment layer 13 may also consist of a wax, or one or more waxes may have been added to the detachment layer 13. The detachment layer 13 in this case will be applied preferably by means of a printing process, more particularly by means of gravure, screen, flexographic, offset, inkjet or pad printing, to the carrier foil 12.

The effect pigment layer 11 comprises effect pigments which are preferably embedded in a binder matrix. The effect pigment layer 11 preferably has a layer thickness of between 0.5 μm and 5 μm, more particularly between 1 μm and 3 μm, more particularly between 1.5 μm and 2.5 μm.

As already observed above, the effect pigment layer comprises not only the effect pigments but also, preferably, one or more binders from the following classes of compound: polyacrylate, polyurethane, polyvinyl chloride, polyvinyl acetate, polyester, polystyrene, and copolymers of the aforesaid classes of compound. Moreover, the effect pigment layer 11 has preferably been admixed with adjuvants, especially rheological additives, more particularly a phyllosilicate, preferably one or more bentonites.

The effect pigment layer 11 preferably has a high degree of filling with effect pigments, more particularly a degree of filling of more than 30 weight percent, preferably between 50 weight percent and 70 weight percent, as for example 60 weight percent, in the solids.

The addition of the above-cited rheological additive is particularly important here for the formulation of the decorative varnish, by means of which the effect pigment layer 11 is formed by means of a coating process on the detachment layer 13. In addition to the components cited, this decorative varnish further comprises one or more solvents, examples being organic solvents, which evaporate after coating has taken place. It is also possible, moreover, for the decorative varnish to be a water-based decorative varnish. As a coating process, a printing process has been found particularly appropriate, especially gravure, screen, flexographic or offset printing.

The addition of the rheological additive to the decorative varnish reduces sedimentation of the effect pigments in the decorative varnish. In contrast to absorption pigments commonly used in printing inks, such as white pigments, for example, which have an approximately spherical form with a diameter of less than 5 μm, more particularly less than 1 μm, effect pigments customarily comprise decidedly large, lumplike structures. As a result of the size and high density of the material, there is comparatively rapid settlement of the pigments and compacting of this precipitate. The settling speed is dependent firstly on the particle morphology but secondly, also, on the property of the medium in relation to the viscosity, density, polarity, etc., and may range from a few days down to a few hours. As long as the printing medium is kept in motion, by shaking or stirring, the dispersion is usually retained. In a coating material at rest, in contrast, settlement is usually unavoidable over the longer term. Where such precipitation occurs, a critical factor is whether it is a soft, bulky precipitate, which can be disrupted again by gentle stirring or shaking, for example, or whether the precipitate is in so compacted a form that the forces between the particles cannot readily be undone by stirring or shaking. A printing medium compacted in this way should be avoided at all costs, since in that case any further use is impossible or virtually impossible.

In order to obtain the precipitate in a soft and bulky form, the addition of the above-recited rheological additives has proven to be advantageous. These additives are added to the decorative varnish preferably at a weight percentage of 1 to 10, more preferably of 2 to 8, more preferably still of 3 to 5. By the corresponding addition of this additive and also, moreover, where appropriate by corresponding accompanying measures in the feeding of the decorative varnish to the printing mechanism, it is possible to improve the settlement characteristics of the effect pigments and so also to tailor the particle area density within the effect pigment layer 11 and also the alignment of the effect pigments of the effect pigment layer 11 through corresponding application of the decorative layer.

It is also possible, furthermore, for the effect pigment layer 11 to comprise not only the effect pigments but also, additionally, absorbing inorganic and/or organic dyes and/or pigments. These dyes and/or pigments preferably absorb a sub-spectrum of the incident visible light and so generate the color of the respective dye or pigment. Furthermore, phosphorescent or fluorescent pigments and/or dyes may be admixed additionally to the effect pigment layer 11.

The fraction of the absorbing pigments among the total amount of the pigments is preferably below 20%, more particularly below 5%, with further preference below 1%.

It has proven appropriate, moreover, if the composition of the effect pigment layer 11 is selected such that at the same time the effect pigment layer 11 provides the function of an adhesive layer. By this means it is possible to do without the adhesive layer 15. This may be brought about in particular by using as binder or binder constituent of the effect pigment layer 11 a binder which is activatable thermally, for example possessing thermoplastic properties or being crosslinkable by means of heat and/or UV radiation. It is possible for the activation in particular also to generate or initiate a crosslinking reaction in the binder of the effect pigment layer 11. Additional curing of the binder of the effect pigment layer 11 may take place by means of UV radiation in an operating step (post-curing) which takes place following the activation by means of heat, in terms of time.

Effect pigments used in the effect pigment layer 11 are preferably transparent, platelet-shaped interference layer pigments. As already observed above, firstly a part of the incident light in the case of such transparent interference layer pigments is reflected preferably at two or more interfaces of the interference layer pigment, and another part of the light is transmitted through the pigment. The transmitted fraction of the light is preferably then absorbed and/or reflected by the ground. Transparent interference layer pigments of this kind preferably have a transparency of more than 30%, more preferably of more than 50%, in the visible spectral range.

Figure 4:
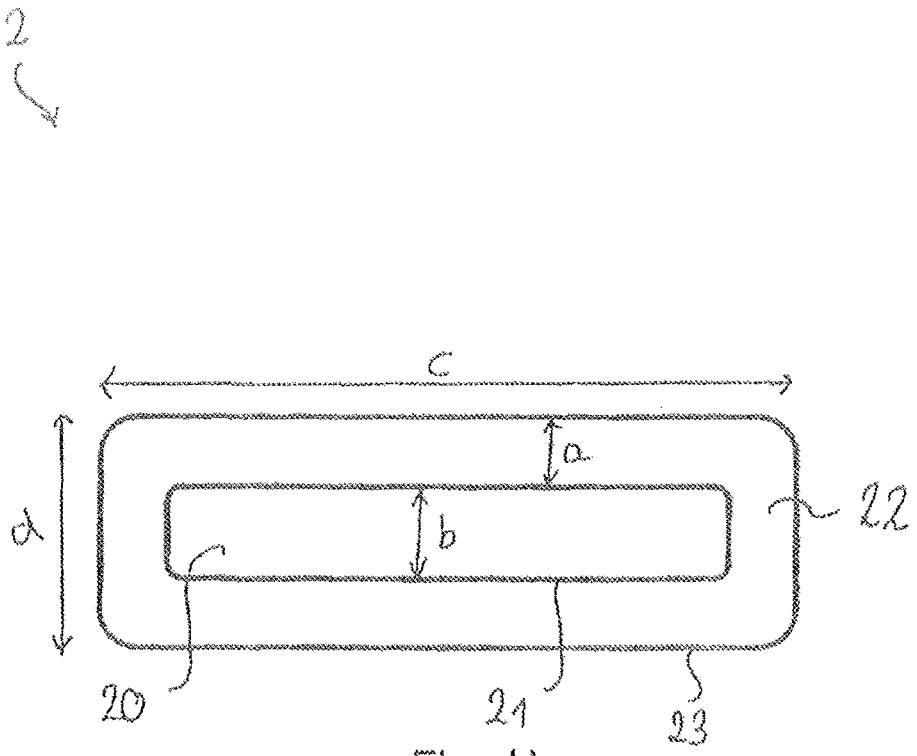
FIG. 4 shows a schematic representation of an effect pigment

A schematic representation of an effect pigment of this kind is shown for example in FIG. 4:

FIG. 4 shows an effect pigment 2 which has an interference layer 22, an auxiliary carrier 20, a first auxiliary layer 21 and a second auxiliary layer 23. Moreover, the effect pigment 2 has a platelet-shaped morphology, with the effect pigment 2 having a diameter c and a thickness or height d. The interference layer 22 also has a layer thickness a, and the auxiliary carrier 20 has a layer thickness b.

The auxiliary carrier 20 serves essentially for increasing the mechanical robustness of the pigment. The auxiliary carrier 20 consists preferably of natural or synthetic mica, aluminum oxide, silicon dioxide, borosilicate glass, or nickel or cobalt. The layer thickness d of the auxiliary carrier 20 is preferably in a range between 100 nm and 1000 nm.

The interference layer 22 consists preferably of iron oxide, zinc sulfide, silicon dioxide, titanium dioxide, not only in the rutile but also in the anatase and brookite modifications, or magnesium fluoride.

The layer thickness a of the interference layer 22 is preferably selected such that interference effects occur in the visible wavelength range. The optical thickness of the interference layer 22 is for this purpose preferably selected such that it meets the $\lambda/2$ or $\lambda/4$ conditions for a wavelength $\lambda$ in the region of visible light.

Optical thickness refers to the product of physical thickness and the refractive index of the layer. This means that layers having a higher refractive index must correspondingly be less thick in order to generate the same optical thickness as a layer having a lower refractive index.

By the $\lambda/2$ or $\lambda/4$ condition is meant the path difference between two or more coherent waves of the incident light. This path difference is critical to the occurrence of interference phenomena. If the path difference between two waves of equal wavelength $\lambda$ with the same amplitude is exactly one half wavelength (plus an arbitrary integral multiple of the wavelength), the two component waves cancel one another out. This attenuation of intensity is called destructive interference. If the path difference is an integral multiple of the wavelength, the amplitudes of the two component waves are added to one another. This case is called constructive interference. At values in between there is a partial cancellation or extinction.

Depending on the refractive index of the material used for the interference layer 22, therefore, the layer thickness a is situated preferably within a range between 50 nm and 500 nm. Through the corresponding layer thickness of the interference layer, the effect pigment acts as a color filter, which reflects or transmits a specified color spectrum in dependence in particular on the incident angle of the light. This also, furthermore, produces preferably a more or less strongly pronounced color change as a function of the incident angle of the light. This color change is particularly strongly pronounced when substances are selected that have a low refractive index for the interference layer 22, whereas it is only weakly pronounced for substances with a high refractive index.

The optional first auxiliary layer 21 serves preferably as a crystallization aid in order to generate the metal oxide layer in a particularly advantageous crystal modification, and it may consist, for example, of tin dioxide.

The optional second auxiliary layer 23 may be provided in order to protect the effect pigment 2 from environmental effects. More particularly this layer ensures that any chemical and/or physical interaction of the effect pigment with the surrounding binder matrix is prevented or minimized. It is also possible, moreover, for a colored metal oxide to be used as second auxiliary layer 23, in order to modify appropriately the color of the effect pigment.

As already observed above, the effect pigment 2 is preferably platelet-shaped in form. "Platelet-shape" here means preferably that the top and bottom sides of the effect pigment 2 are aligned approximately in parallel with one another. Moreover, the height or thickness d of the effect pigment 2 is also much smaller than its diameter c. Thus the height d of the effect pigment 2 is preferably less than 1 μm, whereas the diameter c is between 2 μm and 200 μm, preferably between 5 μm and 35 μm. As well as a discoid embodiment of the platelet-shaped effect pigments, more particularly of the effect pigment 2, however, any desired alternative morphology is also possible, more particularly an irregular morphology, an angular morphology or ellipsoidal morphology of the platelet-shaped effect pigments.

The color impression imparted by such effect pigments derives—in contrast to that of absorbing pigments—essentially from interference phenomena. These phenomena are brought about by multiple reflection at interfaces in the effect pigments—for example, the interface at the front side and the reverse side of the interference layer 22. In this context it is also possible for the effect pigment 2 to have not only one interference layer 22, but instead an even or uneven number of interference layers having different refractive indices, so allowing the filter effect of the effect pigment to be set to a correspondingly narrower band.

Through the choice of the layer thickness for the interference layer 22, as observed above, a portion of the irradiated white light, which contains all wavelengths of the visible spectrum, is extinguished by destructive interference, and another part is amplified by constructive interference, so producing a corresponding color impression in reflection. In transmission, moreover, a corresponding color impression is produced which is complementary to the reflection color.

Because the effect pigments of the effect pigment layer 11 take the form of transparent effect pigments, a large part of the irradiated spectrum can be transmitted through the respective effect pigments and can interact with the background or else with adjacent effect pigments of the effect pigment layer. Furthermore, this also ensures that even on overlap of the halftone dots on the substrate, there is optical superimposition of the optical effects provided by the effect pigments of different halftone dots.

In order to ensure this effect, it is also advantageous, moreover, for the binder of the effect pigment layer 11 as well to be selected such that it is transparent or largely transparent in the visible wavelength range, and more particularly possesses a transmissivity in the visible wavelength range of more than 30%, more preferably of more than 50%, more preferably of more than 80%, relative to a formation in the layer thickness of the effect pigment layer 11.

The size distribution of the effect pigments is preferably selected such that the effect pigments have a lateral extent of between about 1 μm to 35 μm based on the longest extent of the effect pigment. It has further emerged that, as already observed above, the $D_x$ value of the distributors is a further important variable, with x standing for the percentage fraction of the particles which are smaller than the specified value. The preferred range of the particles lies in particular at $D_{90} \leq 35$ μm, $D_{50} < 20$ μm, $D_{10} < 12$ μm. This means that only a very small fraction of the effect pigments are larger than 35 μm, whereas 40% are located in the middle range between 12 μm and 20 μm. This allows a particularly effective compromise between gloss and hiding power of the effect pigment layer 11 and also sufficient applicability of the halftone dots by means of a thermal transfer printhead.

Effect pigments which may be used include, for example, the effect pigments available under the brand name Iriodin, Spectraval or Pyrisma from Merck.

For the production of the true color images it is possible to use a plurality of thermal transfer foils, or else just one specially designed thermal transfer foil.

The thermal transfer foils employed may in this case in principle be formed on the one hand so that they have one or more first regions which comprise first effect pigments. The first region may comprise preferably at least 90% of the area of the effect pigment layer of the thermal transfer foils and/or of the area of the carrier foil, or else may comprise fully the entire area of the effect pigment layer of the carrier foil.

Figure 2:
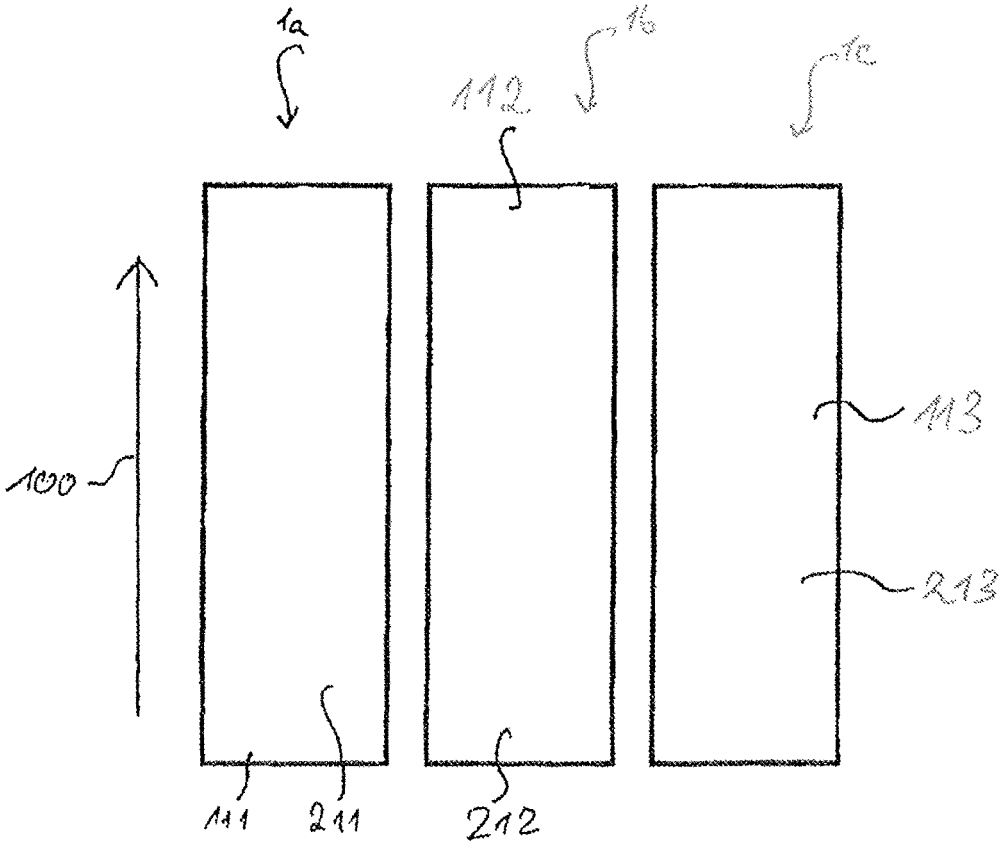
FIG. 2 shows a schematic representation of thermal transfer foils

An exemplary embodiment of this kind is shown in FIG. 2:

FIG. 2 shows by way of example a plurality of thermal transfer foils, namely a first thermal transfer foil 1*a*, a second thermal transfer foil 1*b* and a third thermal transfer foil 1*c*. The thermal transfer foils 1*a*, 1*b* and 1*c* have a formation as set out in relation to the exemplary embodiment according to FIG. 1, and they each have an effect pigment layer 11 with first, second and third effect pigments 211, 212 and 213, respectively. The advancement direction 100 of the thermal transfer foils 1*a*, 1*b*, 1*c* is labelled with an arrow, which preferably also provides the direction of the longitudinal extent of the thermal transfer foils 1*a*, 1*b*, 1*c*.

The effect pigment layer 11 of the thermal transfer foil 1*a* is here formed identically over the entire area or at least 90% of the area of the effect pigment layer 11 or of the carrier foil 12, and in this region, for example, forms a first region 111 which comprises the first effect pigments 211. The thermal transfer foils 1*b* and 1*c* are designed correspondingly, so that their effect pigment layer 11 forms a second region 112 and a third region 113, respectively, in which the second effect pigments 212 and third effect pigments 213, respectively, are provided.

At its most simple, therefore, the effect pigment layer 11 of the thermal transfer foil 1*a* comprises only one kind of color pigments, namely the first effect pigments 211. The second thermal transfer foil 1*b* likewise only comprises a single kind of effect pigments, namely the second effect pigments 212. The thermal transfer foil 1*c* in the simplest case likewise exhibits only one kind of effect pigments, namely the effect pigments 213.

The first effect pigments 211, second effect pigments 212 and third effect pigments 213 differ preferably in terms of their optical effect, more particularly in terms of their color effect and/or alignment. In one preferred embodiment, for example, the first effect pigments 211 are formed, then, by interference pigments with a reddish perceived color, the second effect pigments 212 by interference pigments with a greenish perceived color, and the third effect pigments 213 by interference pigments with a bluish perceived color.

It is also possible, moreover, for the regions 111, 112 and 113 each to comprise not just one effect pigment, but instead to comprise a mixture of two or more different effect pigments, so that the effect pigment layers of the thermal transfer foil 1*a*, 1*b* and 1*c* each comprise a mixture of two or more effect pigments. The mixture of the corresponding effect pigments is here selected preferably such that the regions 111, 112 and 113 differ in relation to their optical effect, more particularly in relation to their color effect. Thus, for example, the respective mixture of the effect pigments in the regions 111, 112 and 113 can be selected such that the regions 111 generate a perceived red color, the regions 112 a perceived green color and the regions 113 a perceived blue color in a particular viewing/illumination scenario.

It is also possible, moreover, for a thermal transfer foil to comprise not just one region but instead two or more of the regions set out above, and so to comprise a plurality of regions each having different optical effects.

Figure 3:
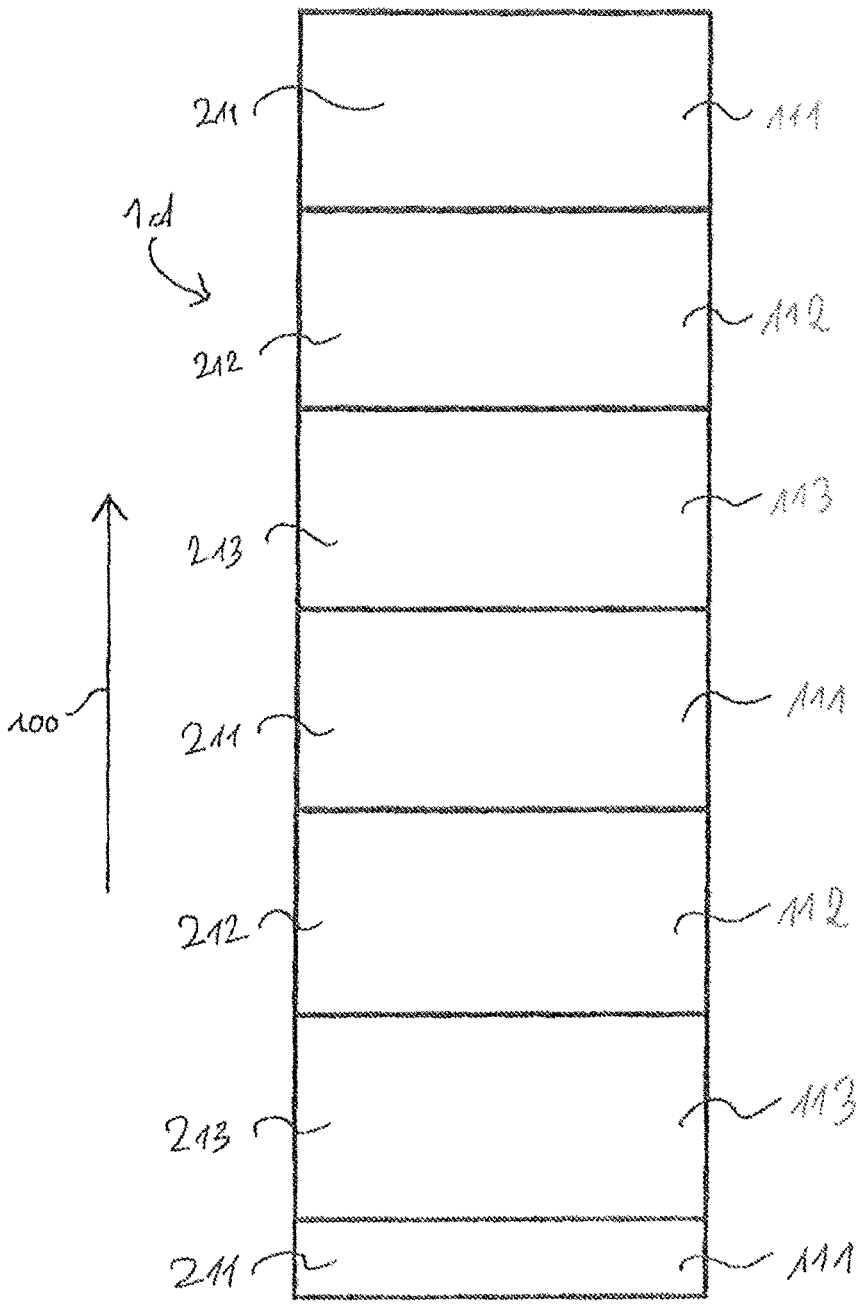
FIG. 3 shows a schematic representation of a thermal transfer foil

Thus, for example, the exemplary embodiment according to FIG. 3 shows a detail of a thermal transfer foil 1*d* which is constructed like the thermal transfer foil according to FIG. 1. This transfer foil in this case has a plurality of first regions 111, second regions 112, third regions 113, which in particular are provided in iterative disposition on the thermal transfer foil 1*d*. In each of the regions 111, 112 and 113, the effect pigment layer generates a correspondingly assigned optical effect, with the optical effect of the first regions 111 being different from that of the second regions 112 and of the third regions 113. Accordingly, the effect pigment layer 11 is of mutually different design in the regions 111, 112 and 113. The advancement direction 100 of the thermal transfer foil 1*d* is marked by an arrow, which preferably also provides the direction of the longitudinal extent of the thermal transfer foil 1*d*.

This has preferably been achieved by providing different effect pigments and/or different mixtures of effect pigments in each of the regions 111, 112 and 113.

As a result of the use of different effect pigments or different mixtures of effect pigments in the regions 111, 112 and 113, a different optical color effect of the effect pigment layer, in particular, is produced in these regions, as already explained above with reference to FIG. 2.

It is also possible, moreover, for the particle area density of the effect pigments to differ in the regions 111, 112 and 113 and/or for the alignment of the effect pigments that is selected to be different in the regions 111, 112 and 113.

In particular, through the different alignment of the effect pigments in the regions 111, 112 and 113, it is possible to achieve, moreover, interesting optical effects in the true color image produced with the thermal transfer foil 1*d* or with the thermal transfer foils 1*a*, 1*b* and 1*c:*

Thus, for example, it is possible for the alignment of the effect pigments to differ in the regions 111, 112 and 113 by virtue of the fact that the alignment exhibits in each case a different angle to the plane defined by the thermal transfer foil, or for the average alignment of the effect pigments to exhibit a correspondingly different angle. This may result in the effect pigments possessing a correspondingly different variable appearance, and so, for example, rendering specific color effects and/or other optical effects visible to the viewer in different spatial regions.

It is also possible, moreover, for the alignment of the effect pigments to exhibit a different statistical distribution about an average alignment in the regions 111, 112 and 113. The effect of this is that, for example, the solid angular range in which the respective color effects are visible is different. Moreover, through a correspondingly selected statistical distribution it is possible on the one hand to generate specific glitter effects and the like and, by virtue of a correspondingly parallel alignment, it is possible on the other hand to generate intensive color flop effects in the regions 111, 112 and 113.

The difference in alignment of the effect pigments in the regions 111, 112 and 113 may be brought about here by corresponding application of these subregions using different printing mechanisms and, further, optionally, by exerting corresponding influence on the alignment of the effect pigments by means of mechanical tools, especially stamping tools, and/or by means of electrical and/or magnetic fields, which are applied correspondingly during the printing operation or during the curing of the decorative varnish on the carrier foil.

Figure 3A:
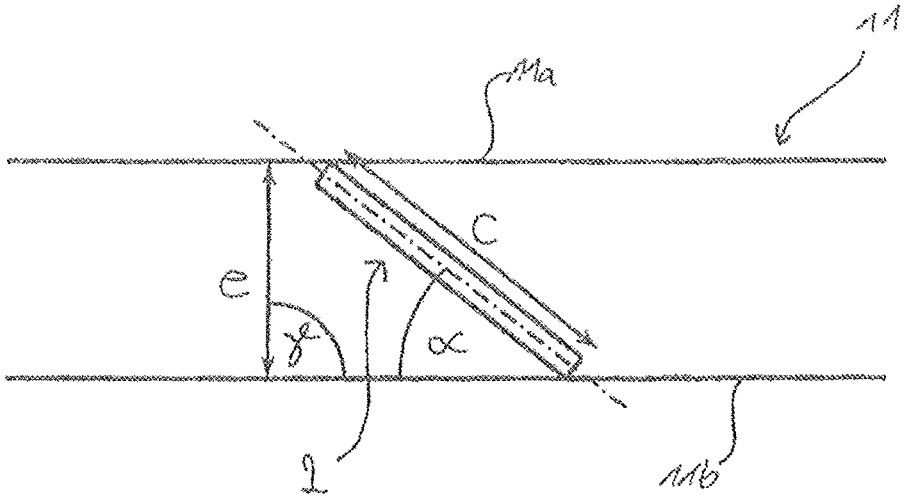

FIG. 3*a* shows an effect pigment layer 11 having a layer thickness e, comprising an effect pigment 2 having an effect pigment size c or a largest diameter c. The effect pigment 2 is tilted by an angle α relative to the plane or surface defined by the effect pigment layer. In this case the effect pigment 2 bears in each case against the first surface of the effect pigment layer 11*a* and the second surface of the effect pigment layer 11*b*. The spacing between the first surface of the effect pigment layer 11*a* and the second surface of the effect pigment layer 11*b* corresponds preferably to the layer thickness e of the effect pigment layer 11. The angle α corresponds to the angle between the surface defined by the effect pigment layer 11, and the normal to the surface defined by the effect pigment layer 11.

When using effect pigments having effect pigment sizes of 1 μm to 35 μm, the $D_{90}$ (90% quantile) of the corresponding effect pigment size distribution is situated for example at between 26 μm and 32 μm, the $D_{50}$ (50% quantile) is located between 14 μm and 19 μm, and the $D_{10}$ (10% quantile) is located between 7 μm and 11 μm. Preferably the greatest part of the effect pigment sizes is located between 10 μm and 30 μm. The layer thickness of the varnish layer e, more particularly of the dry varnish layer, is situated for example between 2 μm and 5 μm. Preferably, depending on the effect pigment sizes, there is an orientation of the effect pigments parallel to the surface defined by the substrate, if the layer thickness of the varnish layer e is less than, or less than or equal to, the effect pigment sizes of the effect pigments.

The angle α is a product of the sine rule with $$\frac{e}{\sin(\alpha)} = \frac{c}{\sin(\gamma)}.$$

The angle α is for example at most 3.8°, if the angle γ=90°, the layer thickness e=2 μm and the effect pigment size c=30 μm. The angle α is for example at most 9.6°, if the angle γ=90°, the layer thickness e=5 μm and the effect pigment size c=30 μm. The angle α is for example at most 11.5°, if the angle γ=90°, the layer thickness e=2 μm and the effect pigment size c=10 μm. The angle α is for example at most 30°, if the angle γ=90°, the layer thickness e=5 μm and the effect pigment size c=10 μm.

The maximum angle α may provide a measure of the tilting of one or more effect pigments 2 included in an effect pigment layer 11. The maximum possible tilting of the respective effect pigments 2 here is limited by the layer thickness e of the effect pigment layer 11 and/or the effect pigment size c.

The alignment of the effect pigments 2 in the effect pigment layer 11 is statistical, and the maximum value of the angle α indicates preferably the maximum disorientation of an individual pigment along a three-dimensional axis. The influence of adjacent pigments may reduce this value further.

A virtual plane-parallel alignment, more particularly a plane-parallel alignment, of the effect pigments 2 parallel to the surface defined by the effect pigment layer 11 is preferred. A virtually plane-parallel or plane-parallel alignment of the effect pigments 2 in the effect pigment layer 11 is advantageous for very highly photorealistic reproduction of images, with avoidance in particular of any viewing angle-dependent change in the perceived color for the viewer.

The alignment of the effect pigments 2 in the effect pigment layer 11 may be dictated with particular advantage through the production operation with predetermined parameters, by the use of predetermined substrates in combination with an extremely thin effect pigment layer 11.

With preference, 90% of the effect pigments 2 have an angle α of less than 10° and/or 50% of the effect pigments 2 have an angle α of less than 5°.

It is also possible, moreover, for the thermal transfer foils used in the process for producing the true color image to comprise not only the thermal transfer foils shown in FIG. 2 but also thermal transfer foils according to FIG. 3, and, moreover, for the thermal transfer foils shown in FIG. 2 to have, in regions, a different alignment or particle area density as in the case of the thermal transfer foil described according to FIG. 3.

It is particularly advantageous if the particle area density of the effect pigments in the respective range 111, 112, 113 is substantially constant as seen over the area of the region in question. In particular it is preferred for this purpose for the standard deviation of the particle area density over the area of these respective ranges to be less than 30%, preferably less than 20%, more preferably than less 10%. This also applies correspondingly, moreover, to the alignment of the effect pigments in the respective range 111, 112 and 113 and/or in relation to the distribution of the alignment of the effect pigments in the regions 111, 112 and 113. This ensures that in the respective regions 111, 112 and 113 an identical, constant optical impression is generated in each case and, as a result, the advantages already set out above are achieved in the process.

The thermal transfer foils designed as above in particular in accordance with the figures of FIG. 1 to FIG. 4 are employed preferably for producing a true color image. In this case, using a thermal transfer printhead, subareas of the effect pigment layer of the thermal transfer foil in the form of halftone dots, or subareas of effect pigment layers of two or more different thermal transfer foils, designed as halftone dots, using one or more thermal transfer printheads, are applied to the surface of a substrate in order to form the true color image. Thus, for example, one or more of the transfer foils 1*a*, 1*b*, 1*c* and 1*d* are used to produce the true color image, using a thermal transfer printer which comprises one or more thermal transfer printheads.

Figure 6:
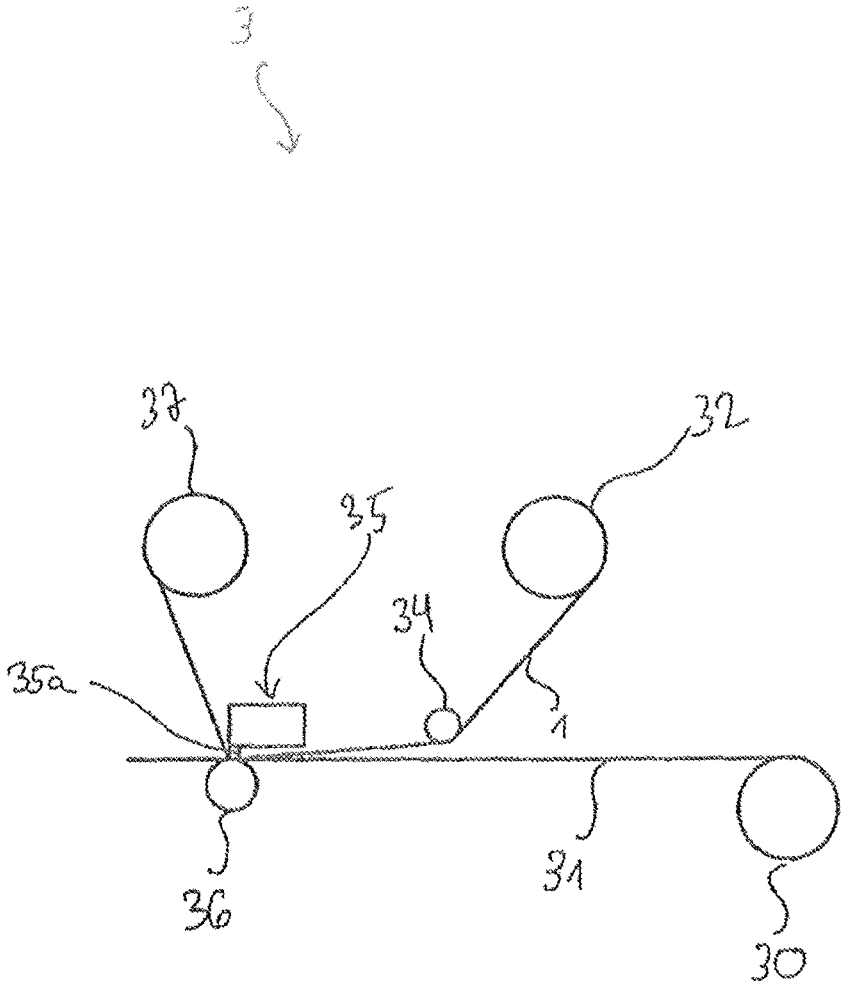
FIG. 6 shows a schematic representation of a thermal transfer printing apparatus

The basic construction of a thermal transfer printer which can be used for this purpose is shown by way of example in FIG. 6.

FIG. 6 shows the thermal transfer printer 3 with the thermal transfer printhead 35, the heating element 35*a*, the counter-pressure roller 36, the thermal transfer foil winder 37, the deflection roller 34, and the thermal transfer foil unwinder 32. Also shown in FIG. 6 is the thermal transfer foil 1, which is unwound by the thermal transfer foil unwinder 32 and is supplied via the deflection roller 34 to the printhead 35, and then wound up again on the thermal transfer foil winder 37. FIG. 6 additionally shows a substrate 31. The substrate 31 is unwound by the substrate unwinder 30 and then supplied to the nip between counter-pressure roller 36 and printhead 35 or heating element 35*a*. The thermal transfer foil unwinder 32, the thermal transfer foil winder 37, the counter-pressure roller 36 and/or the substrate unwinder 30, and also the printhead 35, are driven by a control means, not shown in FIG. 6, in such a way that by means of the printhead 35 or the heating element 35*a*, subareas in the form of halftone dots in the effect pigment layer 11 of the thermal transfer foil 1 are transferred onto the substrate 31 surface facing the printhead 35.

The printhead 35 is designed preferably as a "flat head" printhead. In this case the position of heating elements 35*a* (thermocouples) of the printhead 35, at which the subareas of the effect pigment layer are applied to the substrate 31, is located preferably between 5 mm to 10 mm distant from the edge of a support plate, more particularly a ceramic support plate. The heating elements 35*a* in this case are designed in particular as a heating strip, on which the heating elements 35*a* are disposed closely alongside one another in a line. The carrier foil 12 of the thermal transfer foil 1, with the remaining, unapplied effect pigment layer 11, is taken off upwards preferably via an additional diverting plate, not shown in FIG. 6, and/or via an additional roll, from the substrate 36. Separation between the carrier foil 12 and the substrate 31 is accomplished with a certain temporal and spatial retardation after heat has been given off via the printhead 35. The temporal and spatial retardation may be advantageous in order to allow the applied effect pigment layer 11 to develop a greater adhesion on the substrate 31 within this time, with the carrier foil 12 only thereafter being peeled off from the applied effect pigment layer 11.

It is possible, moreover, for the thermal transfer printer to use a "near-edge" thermal transfer printing process. In the case of this printing process, the position of the heating elements 35*a* (thermocouples) of the printhead 35 is located very close to the edge of the support plate. Here as well, the heating elements 35*a* take the form in particular of a heating strip, on which the heating elements 35*a* are disposed alongside one another closely in a line. The carrier foil 12 of the thermal transfer foil 1 with the unapplied residual effect pigment layer 11 is taken off upwards from the substrate 31 without additional diversion, at a sharp angle, as shown in FIG. 6. The separation of the carrier foil 12 from the substrate 31 therefore takes place immediately after the transfer of the subareas of the effect pigment layer 11 from the carrier foil 12 onto the substrate 31, by means of the partial heating of the thermal transfer foil 1 by the printhead 35. An advantage in this variant is that as a result it is possible to achieve higher printing speeds.

With regard to inter-layer adhesion and force of adhesion to the substrate 31, respectively, the layers of the thermal transfer foil 1, more particularly the effect pigment layer 11 and the optionally provided detachment layer 13, and adhesive layer 15, respectively, are preferably set as follows:

The partial heating of the thermal transfer foil 1 by the heating elements 35*a* of the printhead 35 employed in the respective process produces a change in the behavior of this layer system: in the regions in which the transfer foil 1, which is in contact with the substrate 31, is not heated by the heating elements 35*a* of the printhead 35, the inter-layer adhesion between the effect pigment layer 11 and the carrier foil 12 is higher than the force of adhesion between the effect pigment layer 11 and the substrate 31. In the regions in which the thermal transfer foil 1 in contact with the substrate 31 is heated by the heating elements 35*a* of the printhead 35, corresponding activity of the thermoactivatable adhesive layer 15 and/or of the thermoactivatable effect pigment layer 11 produces an increase in the force of adhesion between the effect pigment layer 11 and the substrate 31, and possibly a reduction in the force of adhesion between the effect pigment layer 11 and the carrier foil 12, as a result of reduced force of adhesion of these two layers to one another—by melting of the detachment layer 13, for example.

The increase in the force of adhesion between the effect pigment layer 11 and substrate 31 is formulated here in such a way that within these regions the force of adhesion between the effect pigment layer 11 and the substrate 31 is higher than between the effect pigment layer 11 and the carrier foil 12. In this way, the subareas of the effect pigment layer 11 that are acted on by heat, by means of the heating elements 35*a* of the printhead 35, are applied to the substrate 31. In this case it is also possible for the effect pigment layer and/or the adhesive layer 15 to be able briefly to melt and so to enter into a particularly intimate connection with the substrate 31.

A further effect of this setting of the force of adhesion of the layers of the thermal transfer foil 1, as described above, is that when the thermal transfer foil 1 is peeled from the substrate 31, the subareas of the effect pigment layer 11 that have been heated by the heating elements 35*a* of the printhead 35 remain on the substrate 31, and the remaining subareas of the effect pigment layer 11 are detached with the carrier foil 12 from the substrate 31.

As already observed above, the thermal transfer printer 3 may have not only one printhead 35, but also two or more printheads 35. In that case it is also possible for each of these two or more printheads 35 to be assigned one thermal transfer foil among a plurality of thermal transfer foils used, or else for the same thermal transfer foil to be supplied to two or more printheads 35.

These one or more printheads 35 the supplying of the one or more thermal transfer foils 1 and also the supplying of the substrate 31 is controlled in this case, depending on the thermal transfer foils used and also on the true color image to be produced, preferably as described below:

At the print preparation stage, the print original—which, as set out above, preferably is a single-color or multicolor motif to be represented as a true color image—first broken down into its color channels.

As already set out above, the color channels are oriented on the one or more thermal transfer foils used for producing the true color image. Preferably, then, each of the available regions of the one or more transfer foils possessing a different optical effect is assigned a color channel.

These color channels may therefore be color channels of a customary color model, for example RGB, hence a red color channel, a green color channel and a blue color channel. As a result, the respective color of the respective color channel is generated by the particular region of the thermal transfer foil, as a result of the effect pigments provided there.

Moreover, however, it is also possible and advantageous to define and provide here corresponding color channels which take account of the optical color effect in a predefined viewing angle range, or of additional optical effects besides the color effect, such as glitter effects, etc., for example. Hence for example it is possible for one and the same color to be assigned a plurality of color channels—for example, a first color channel in respect of a corresponding color effect in a first viewing angle range; a second color channel in respect of the same color effect in a different viewing angle range; and a third color channel with a corresponding color effect, but superimposed, for example, by a glitter effect, likewise in a specific viewing angle range.

The corresponding breakdown of the motif into the color channels may be based here on the basis also of further information concerning the desired optically variable effects of the motif, or else based optionally on a three-dimensional representation of the motif.

For each of the color channels, an assigned grayscale image is determined in the digital original of the motif and in the information that may additionally be available. In one preferred case, therefore, there is a first grayscale image for a red color channel, a second grayscale image for a green color channel, and a third grayscale image for a blue color channel.

The respective grayscale images are then converted via appropriate algorithms and calculation methods, as for example by means of an RIP (RIP=Raster Image Processor) specifically designed for the purpose, into a respective raster image consisting of a multiplicity of halftone dots. The size of these halftone dots corresponds preferably to the size of the individual pixels which can be resolved by the printhead used. A raster image of this kind may consist, for example, of a binary black-white bitmap.

In the course of this conversion, the grayscale image is broken down preferably into raster cells. Each raster cell comprises a certain number of binary pixels, namely the halftone dots. The halftone dots provided in the particular raster cell simulate the grayscale or color scale of the particular color channel.

The conversion of the grayscale image into the respective raster image may be realized in this case by means of various rastering methods.

With amplitude-modulated rastering with raster cells, for example, rastering takes place in raster cells following one upon another in a stipulated size and with a stipulated raster width, i.e., period. The individual halftone dots therefore comprise one or more of the individual pixels which can be implemented by the printhead 35. Within the raster cell, the respective grayscale is simulated by means of a variable size of the individual halftone dots. The halftone dots are varied in their size and may also have different shapes (for example dot shape, rhomboidal shape, cross shape). Through the size of the rasters the areal occupancy by the halftone dots within the raster cells, and hence the color gradation or gray gradation of the rasters, is stipulated in this way.

Another method is that of frequency-modulated rastering with fixedly predetermined halftone dot sizes but with a varying distance between the halftone dots in the x and y directions and/or in the advancement direction and normal to the advancement direction of the substrate. In this case, preferably, the size of the halftone dots corresponds to the size of the individual pixels which can be implemented by the printhead 35. Here there is preferably a virtually random distribution of the spacings between the halftone dots, and for this reason this rastering may also be referred to as stochastic rastering.

In specifying the parameters of the rastering, one consideration which must be made is that of the fineness which the representation is to have, necessary in particular for fine image details, and another is the level of gradation the particular color is to represent. The finer the selected raster width, the better the representation of fine image details. The finer the selection of the raster width, however, the smaller too are the raster cells generated and the fewer pixels are available in the respective raster cell for variation of the halftone dots. Since the respective grayscale or color gradation of the color channel is to be simulated within the respective raster cell, it is advantageous for there to be a maximum number of pixels available for the simulation of a maximum number of fine gray gradations. The fewer pixels there are in the raster cell, the fewer the color gradations that can also be simulated in the raster cell. The fewer color gradations there are available, the less realistic or natural the effect of the true color image, particularly as a result of tone separation effects (known as posterizing or posteration).

If the true color image, for example, is to be executed with a resolution of 300 dpi (dpi=dots per inch, pixels per inch), it has proven appropriate to carry out the rastering of the color channels in each case with a raster width of 35 lpi to 70 lpi (lpi=lines per inch), in particular with amplitude modulation. This results in raster cells having sizes of between 8×8 pixels (35 lpi) and about 4×4 pixels (70 lpi). With 8×8 pixels it is possible to represent 64 gray gradations per color channel. With 4×4 pixels per color channel it is possible to represent 16 color gradations per color channel.

Figure 8:
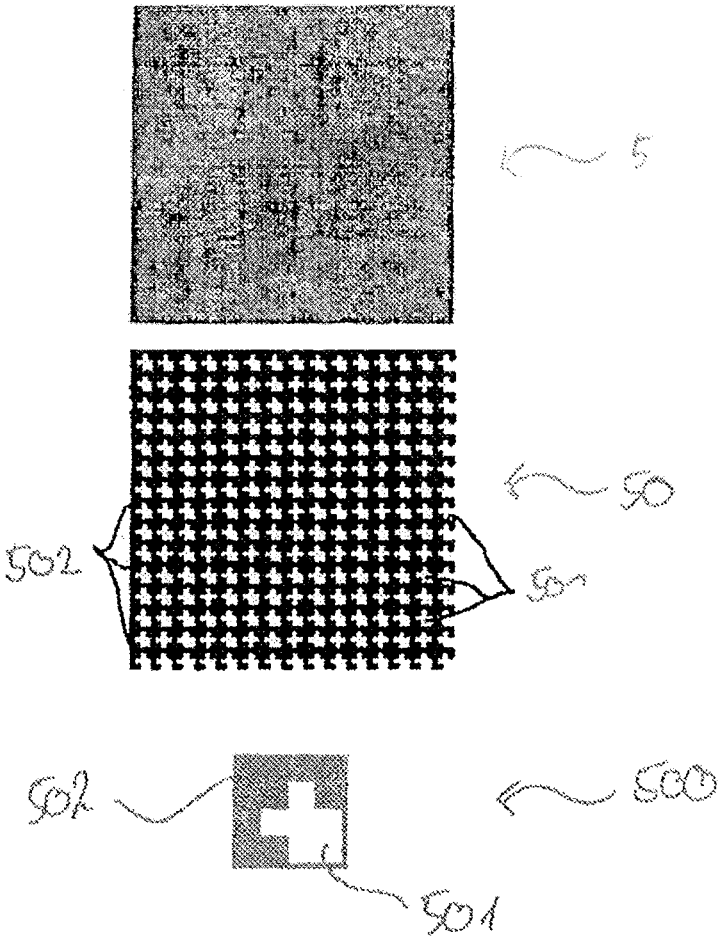
FIG. 8 shows a schematic representation of a rastering

FIG. 8 now illustrates a detail from a raster pattern, determined by means of the method, set out above, of amplitude-modulated rastering from an area with 50% gray gradation or color gradation, for one of the color channels:

Accordingly, a representation 5 shows one such area detail of the raster pattern; a representation 50 shows a detail of the representation 5, enlarged by 500%; and a representation 500 shows a detail of the representation 5, enlarged again by 500%, with the representation of an individual raster cell 502. This is based on the examples given above with a raster width of 70 lpi. The representation 500 here illustrates by way of example the raster cell 502, which comprises 4×4 pixels and has the halftone dot 501, which is formed by the area of the pixels designed in white.

Figure 9:
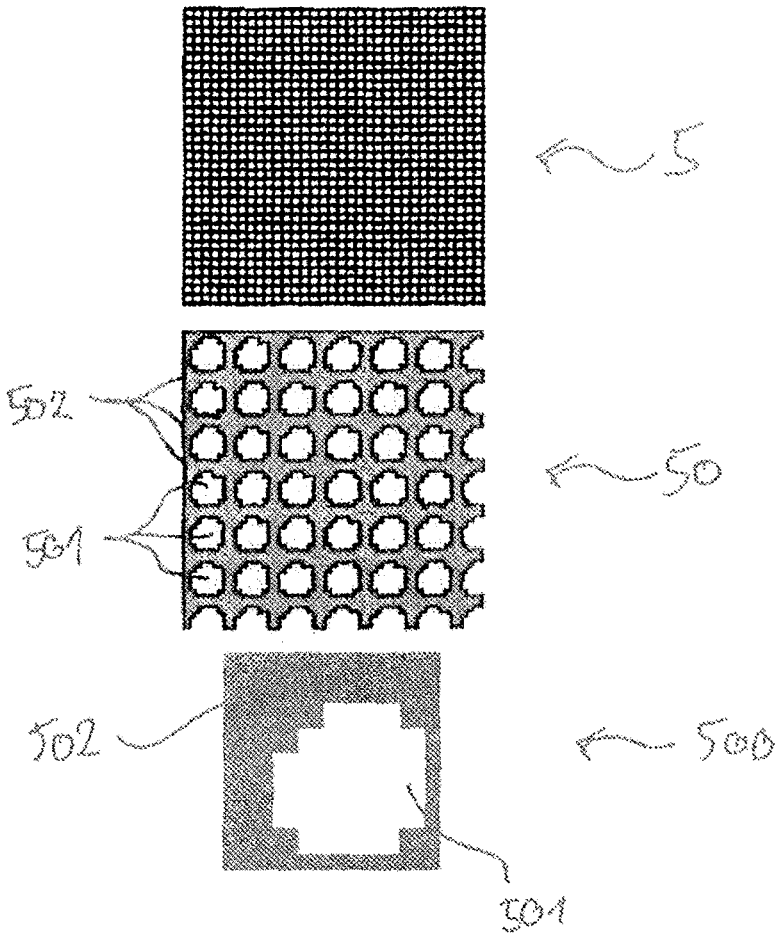
FIG. 9 shows a schematic representation of a rastering

FIG. 9 illustrates the corresponding detail from the raster pattern for the above-expanded raster width of 35 lpi. The representation 5 shows the detail from the raster pattern. The representation 50 a detail enlarged by 500%, and the representation 500 a detail therefrom again enlarged by 500%, with the raster cell 502, which comprises 8×8 pixels and features the raster dot 501.

It is also possible, moreover, to use other raster methods for determining the raster pattern. Hence it is possible, for example, to use a frequency-modulated rastering which has no fixed raster cells. In that case the rastering follows only on the basis of the print resolution of 300 dpi with correspondingly free positioning of the individual pixels or halftone dots.

Figure 7:
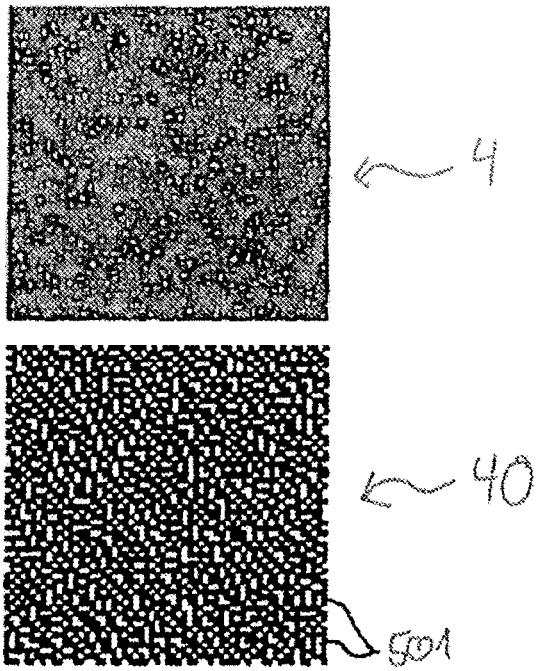
FIG. 7 shows a schematic representation of a rastering

FIG. 7 shows, by way of example, a representation 4 of such a detail, rastered by means of frequency-modulated rastering, also called "diffusion dither", for a raster pattern corresponding to a gray gradation or color gradation of 50%. The representation 40 a detail therefrom enlarged by 500%, with the individual halftone dots and individual pixels 501.

A resolution of 600×600 dpi corresponds in particular to a pixel size of 42 μm×42 μm, and a resolution of 300×300 dpi corresponds in particular to a pixel size of 84 μm×84 μm. Where the average largest diameter of the effect pigments is between 1 μm to 35 μm, for example, it is then advantageous that within one pixel, a plurality of effect pigments may be disposed partially or completely and also above one another and/or alongside one another, in order to generate as bright as possible an optical effect per pixel (and hence per color channel). The smaller the effect pigments used, the greater the number of effect pigments that can be disposed in particular within a pixel and the smaller, preferably, is the typical pearl luster effect which can be generated. The larger the effect pigments, the greater, in particular, the pearl luster effect and the fewer the number of effect pigments which can be disposed preferably within a pixel. Within a pixel, for example, it is possible for about 1 to about 7000 effect pigments, preferably about 10 to about 1000 effect pigments, more preferably about 10 to about 500 effect pigments, to be disposed partly or completely and also above one another and/or alongside one another.

For the generation of the true color image on the substrate from the raster pattern of the color channels, the color channels must be combined with one another, by corresponding application of the halftone dots on the substrate, in such a way that additive and/or subtractive color mixing of the halftone dots produces the true color image, and more particularly the selected true color image or motif. This is brought about by driving the printheads and/or advancement apparatus in such a way that the raster patterns and therefore halftone dots assigned to the color channels are applied to the substrate, accordingly, in a manner with precise register to one another. In such a way that a correspondingly local color mixing can take place.

Register, or register accuracy or in-register status, refers to a positional accuracy of two or more elements and/or layers relative to one another. The register accuracy here is to range within a prescribed tolerance, and is to be as minimal as possible. At the same time, the register accuracy of two or more elements and/or layers to one another is an important feature for increasing operational reliability. Site-accurate positioning may be accomplished here in particular by means of sensory, preferably optically detectable, registration marks or register marks. These registration or register marks may represent specific separate elements and/or regions and/or layers, or may themselves be part of the elements and/or regions and/or layers to be positioned.

The driving in question takes place in particular here in such a way that the true color image has a multiplicity of true color domains which, when illuminated and viewed under reflected light and/or transmitted light, convey an assigned true color to the human viewer. This true color is generated in each case in particular by additive and/or subtractive color mixing of the halftone dots applied in the respective true color domain, on illumination.

With the raster cells described above, comprising 8×8 pixels per color channel and 64 color gradations per color channel, accordingly, the number of shades resulting in the case of three color channels, for example, is 64×64×64=262 144 shades. With the above-described raster cells of 4×4 pixels per color channel and 16 color gradations per color channel, the number of shades in the case of three color channels is 16×16×16=4096 shades, which are available for a particular true color image. With this large number of shades, true color images with a realistic and natural effect can be produced.

It has proven to be advantageous, furthermore, not to select too fine a rastering, in order in particular to select the rastering within the above-described ranges between 35 lpi and 70 lpi. Hence it has emerged that in the case of pixels or halftone dots which are too fine, there is reduced reproduction of detail and inaccurate shaping of the individual pixels, so falsifying the reproduction of color.

The processes described above are carried out preferably by means of corresponding image processing software, which may be implemented on the controller of the printer 3 or separately on an external computer.

Based on the raster patterns determined as set out above for the individual color channels, the printer 3 may be driven accordingly as described below in order to implement the process:

If the printer 3 has only one printhead 35, which is disposed transverse to the advancement direction, i.e., print line transverse to the advancement direction, an advisable procedure is as follows:

In one case it is possible to use different thermal transfer foils, each coated over their full area with an effect pigment layer which has a uniform optical appearance. Each of these thermal transfer foils is assigned to one of the color channels. These thermal transfer foils may therefore, for example, be the thermal transfer foils 1*a*, 1*b* and 1*c* elucidated with reference to FIG. 2.

In one preferred implementation, the effect pigment layer of a first foil, on illumination (and at a defined angle), conveys the red color impression, while a second of the thermal transfer foils conveys the green color impression and a third of the thermal transfer foils conveys the blue color impression.

First of all, then, the raster pattern assigned to the color channel of the first thermal transfer foil, such as to the red color channel, for example, is sent to the controller of the printer. The printer controller drives the printhead 35 in such a way that by means of the printhead 35 the halftone dots assigned to this raster pattern, consisting of subareas of the effect pigment layer of the first thermal transfer foil (for red color channel), are applied to the substrate 31, more particularly to a black substrate 31. Following application, the first thermal transfer foil is switched for the second thermal transfer foil (for green color channel). The substrate 31 is again moved into the start position. The raster pattern which is assigned to the second color channel, as for example the green color channel, is subsequently sent to the controller of the printer. The assigned halftone dots are then applied in the same way by means of the printhead 35, through corresponding application of subareas of the effect pigment layer of the second thermal transfer foil. This is repeated in the same way in a third step with the third thermal transfer foil and the third color channel, for the blue color channel, for example.

The positioning of the substrate 31 at the starting position is accomplished here preferably by means of a stepper motor which controls the advancement of the substrate. Here there are two variants which have proven useful:

In the first variant, the substrate 31 has a perforation in at least one edge region, and the corresponding lugs engage in this perforation. The substrate 31 is then moved forwards and backwards via this mechanical interlocking.

In the second variant, the substrate 31 has no perforation. Here it is clamped in mechanically between two rolls and is fixed forward and backward there throughout the period of advancement, so that the forward path is known and the substrate can be moved back again correspondingly.

Register tolerance in the advancement direction and/or perpendicular to the advancement direction here is approximately ±0.15 mm, preferably in the ±0.05 mm to ±0.5 mm range.

Further, it is also possible in the case of such a printer to use only a single thermal transfer foil, having a plurality of regions with different optical effects, especially color effects. This thermal transfer foil may be designed in the same way, for example, as the thermal transfer foil 1*d* according to FIG. 3. Thus, for example, this thermal transfer foil has an iterative arrangement of regions 111, 112 and 113, which are each assigned to a different color channel and which on illumination, for example, reproduce the colors red, green and blue, respectively. The size of the regions is in this case oriented preferably on the running length of the image or motif to be printed. This single thermal transfer foil may additionally comprise further regions—for example, for an additional white or black color or another chromatic color or an optically variable color or optically variable layer sequences, or for a protective varnish which is applied partially or over the full area of the true color image following application of the true color image.

The individual color channels are printed in the same way as described above in succession by corresponding transmission of the respectively assigned raster pattern to the controller of the printer, and, after the respective printing of a color channel, the substrate 31 is moved back into the starting position. There is no need here to change the thermal transfer foil, owing to the specific design of the thermal transfer foil, as described above.

It is advantageous, moreover, if the printer has a plurality of separate printheads 35 with a respectively assigned transfer foil. Preferably in this case there is a printhead 35 with assigned thermal transfer foil 1 provided for each of the color channels. The printheads 35 here are positioned in succession, so that the halftone dots of the individual color channels are applied successively to the substrate 35, without any need for the substrate 35 to be moved back to the starting position. Here, preferably, the distance between the printheads 35 in the printer is known and fixed and is observed accordingly during printing. The register tolerance in advancement direction and/or perpendicular to the advancement direction here is approximately ±0.1 mm, preferably in the range between ±0.05 mm to ±0.5 mm.

It is also possible, moreover, for the printer to have a printhead 35 which is disposed longitudinally to the advancement direction, i.e. printing line longitudinally to the advancement direction. With an arrangement of this kind it is advantageous to use a plurality of different thermal transfer foils. Preferably an assigned thermal transfer foil is used for each of the color channels, each of said foils being designed, as already described above, over the full area with an effect pigment layer, which exhibits an optical effect assigned to the respective color channel. The printhead 35 prints a corresponding stripe of the substrate 35 in accordance with the width of the printhead, in this case preferably with all color channels. The substrate 31 remains in position until all of the color channels have been printed. Thereafter the substrate 31 is displaced by a predetermined value (printhead width). In this case the change of the thermal transfer foil takes place preferably automatically. The register tolerance in advancement direction and/or perpendicular to the advancement direction here is approximately ±0.1 mm, preferably in the range between ±0.05 mm to ±0.5 mm.

As already set out above, the optical appearance of the true color image is also determined by the substrate 31. With regard to the substrate used, more particularly the substrate 31, the following advantageous design variants arise in particular:

Thus it is possible for the substrate 31 to be black or dark and/or to be applied on a black or dark surface. In view of the black or dark ground thus formed by the substrate, the light that is not reflected by the effect pigments is absorbed or largely absorbed. In reflection, as a result, all that can be seen is essentially the part of the spectrum reflected by the effect pigments, so producing a very clean and intense color impression.

It is also possible, moreover, for the substrate to possess a strongly reflecting quality—having, for example, a metal layer or having a white ink layer or white ink area. The effect of this is that part of the light transmitted by the effect pigments of the halftone dots is reflected at this ground. As a result, interesting color effects can be achieved. This is the case because when transparent effect pigments are used, as elucidated above, the color spectrum differs in transmission and reflection and so the color generated by the effect pigments in transmission or in reflection becomes visible in dependence on angle.

It is also possible, furthermore, for the substrate to form a colored ground or to have colored regions which, for example, reflect only part of the irradiated spectrum. As a result it is possible, in combination with the overlying effect pigments provided in the halftone dots, to achieve a deliberate modification of the perceived color.

Hence the substrate preferably has at least one colored varnish coat, which may be provided over the full area or in patterns on the substrate. The luminance L* of the at least one colored varnish coat is preferably in the range from 0 to 90. The luminance L* here is measured preferably according to the CIELAB form L* a* b*, under the following conditions:

According to geometry: diffuse/8 degrees as per DIN 5033 and ISO 2496 diameter of the measuring aperture: 26 mm spectral range 360 nm to 700 nm as per DIN 6174, standard illuminant: D65.

Figure 5:
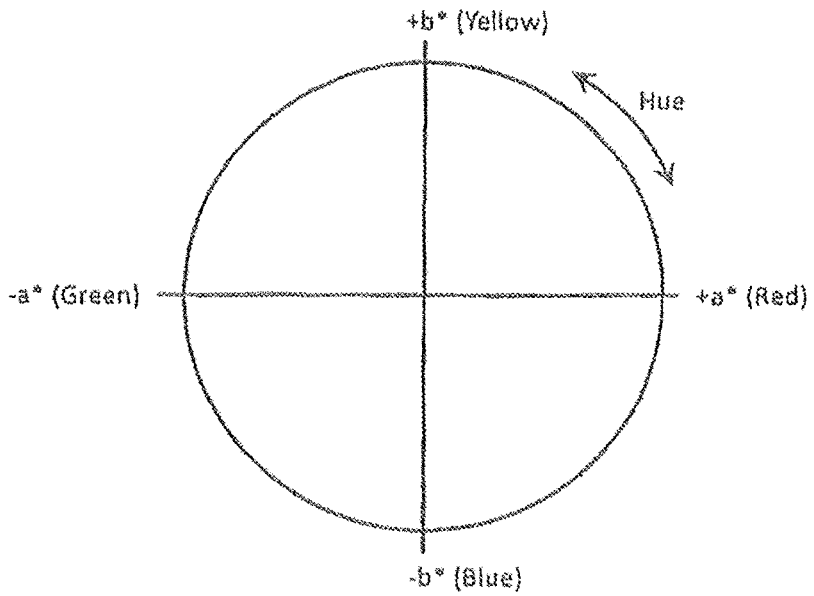
FIG. 5 shows a schematic representation of a color space
Figure 5:
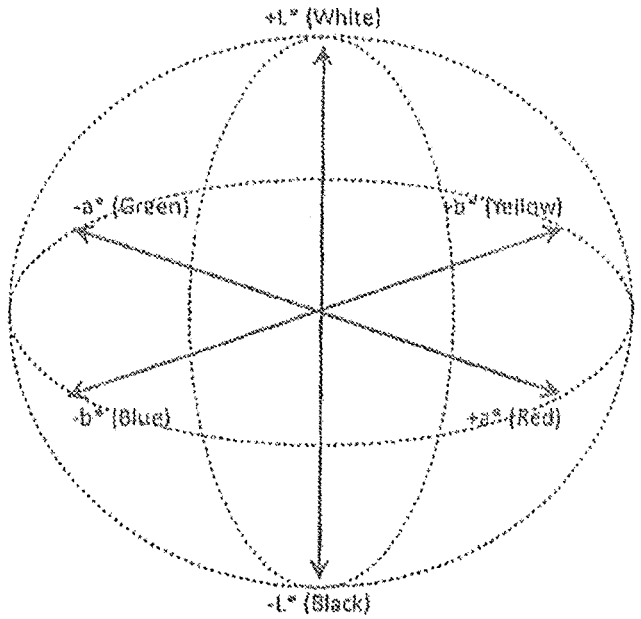

FIG. 5 shows, in the upper part of FIG. 5, a two-dimensional coordinate system defined by the coordinate axes a* and b*, the system being designated here as "a*, b* chromaticity diagram". In this case the color values on the axis a* range from green in the negative region through to red in the positive region of the possible values of a*. Moreover, the color values on the axis b* range from blue in the negative region through to yellow in the positive region of the possible values of b*.

Furthermore, FIG. 5, in the lower part of FIG. 5, shows a three-dimensional coordinate system which is defined by the coordinate axes L*, a* and b*, and which also comprises the two-dimensional coordinate system defined by the axes a* and b*. In this case the color values on the axis a* range from green in the negative region through to red in the positive region of the possible values of a*.

Moreover, the color values on the axis b* range from blue in the negative region through to yellow in the positive region of the possible values of b*. Furthermore, the luminance values on the axis L* range from black in the negative region through to white in the positive region of the possible values of L*.

The individual colored varnish coats here may be colored using dyes and/or pigments. Pigments are given preference here, in view of the customarily higher hiding power relative to dyes.

For the coloring of the pigments it is advantageous if the pigmentation of the at least one colored varnish coat is selected such that a pigmentation number PN is in the range from 1.5 $cm^3/g$ to 120 $cm^3/g$, more particularly from 5 $cm^3/g$ to 120 $cm^3/g$. The pigmentation number PN here is calculated as already set out above.

As already set out above, it is advantageous for the color effect of the true color image if the substrate is black or dark or has a correspondingly black or dark layer.

It is, however, also possible to combine with one another the implementation alternatives of the substrates that are described above. Thus, for example, a substrate may be provided which in regions is black or dark, in regions is strongly reflecting or white, and in regions is provided with different-colored colored varnish coats. Through the corresponding design and/or the preprinting of the substrate, the optical appearance of the true color image may be further influenced and by this means further optically variable effects can be generated, which are difficult to imitate by other methods.

It is in particular also possible, before and/or else after application of the true color image to the substrate, for further layers or layer sequences to be applied to the substrate 31 that represent an overall motif together with the motif of the true color image. The further layers or layer sequences may likewise be applied to the substrate 31 by means of thermal transfer foils or else by means of other processes such as, for example, gravure, flexographic, screen, pad or inkjet printing, hot stamping, cold stamping, or other known processes.

The further layers or layer sequences may for example take the form of transparent and/or translucent and/or opaque color layers, transparent and/or translucent and/or opaque metallic layers (applied by vapor deposition and/or sputtering and/or printing), an open or embedded replication layer with diffractive and/or refractive relief structures, more particularly with a transparent and/or translucent and/or opaque reflection layer disposed thereon in the form of a thin metal layer and/or an HRI layer with high refractive index (HRI=High Refractive Index) and/or as an LRI layer with a low refractive index (LRI=Low Refractive Index), a volume hologram, a transparent and/or translucent and/or opaque thin-film construction, particularly according to Fabry-Perot with absorption layer, spacer layer and reflection layer, or other known layers or layer sequences.

By means of such layers applied previously and/or subsequently it is possible, for example, for individual subregions of the true color image to be emphasized with accentuation or else attenuated. For example, contours or subareas of the true color image may be given correspondingly different designs in this way. The true color image, for example, may be embedded or inserted into an overall motif and/or into an overall pattern by means of such layers applied before and/or after, so that the true color image can be disposed adjacently to the layers applied before and/or after.

By way of example it is possible, by means of such layers applied previously or subsequently, for functional layers as well to be applied retrospectively to the true color image, these layers being in the form, for example, of a transparent protective varnish for sealing the true color image, applied in particular by means of thermal transfer printing, hot stamping or cold stamping. Likewise possible is the application of an adhesion promoter layer or primer layer to the substrate before the application of the true color image.

The registered tolerance in advancement direction and/or perpendicular to the advancement direction between the true color image and the further layers or layer sequences here is approximately ±0.15 mm, preferably in the ±0.05 mm to ±0.5 mm range.

Furthermore, it is also possible and advantageous if in the process, as well as the above-described transfer foils with effect pigment layer, use is made of one or more thermal transfer foils which have a transfer color layer containing no effect pigments. Thus it is possible, for example, to use the printer additionally to apply halftone dots to the substrate that have dyes and/or pigments which are based on absorption of the incident light. Hence it is possible, for example, additionally to use a thermal transfer foil which has a transfer ply formed by a white varnish layer.

It is also possible, moreover, for further processing steps for producing the true color image to be carried out after the printing of the substrate.

Hence it is possible, for example, for the substrate to be a transparent substrate whose facing side is printed with the printer 3. The substrate is subsequently applied by the reverse face to a preferably black/dark background, and the reverse face is printed in a further operation in order to provide in particular a multicolored background, as set out above.

It is also possible, moreover, for the print to take place using the printer 3 onto the transparent substrate with mirror inversion. This is followed by the application of a preferably black/dark background to the printed side of the transparent substrate. In this way the transparent substrate protects the imprint provided between the transparent substrate and the black background.

To improve the stability, the substrate printed with the printer 3 may also be protected on one or both sides with additional transparent overprints, laminates, plastic or glass sheets.

LIST OF REFERENCE SYMBOLS

1 Thermal transfer foil
1*a* First thermal transfer foil
1*b* Second thermal transfer foil
1*c* Third thermal transfer foil
1*d* Fourth thermal transfer foil
11 Effect pigment layer
11*a* First surface of the effect pigment layer
11*b* Second surface of the effect pigment layer
12 Carrier foil
13 Detachment layer
14 Backside coating
15 Adhesive layer
100 Advancement direction
111 First region
112 Second region
113 Third region
114 Fourth region
2 Effect pigment
20 Auxiliary carrier
21 First auxiliary layer
22 Interference layer
23 Second auxiliary layer
211 First effect pigments
212 Second effect pigments
213 Third effect pigments
214 Fourth effect pigments
3 Thermal transfer printer
30 Substrate unwinder
31 Substrate
32 Thermal transfer foil unwinder

34 Deflection roller
35 Thermal transfer printhead
35*a* Heating element
36 Counter-pressure roller
37 Thermal transfer foil winder

The invention claimed is:

1. A process for producing a color image comprising:

providing one or more thermal foils having an effect pigment layer and a carrier foil, the effect pigment layer comprising effect pigments; and applying subareas of the effect pigment layer of at least one of the one or more thermal transfer foils to a first surface of a substrate using one or more thermal transfer printheads, whereby effect pigments having different optical effects and/or orientations are transferred from the subareas to form two or more halftone dots on the substrate, said two or more halftone dots being formed in such a way that additive and/or subtractive color mixing of the two or more halftone dots form the color image, wherein the color image consists of a multiplicity of color domains which, when illuminated and viewed in reflected light or in transmitted light show a color, and wherein the at least two halftone dots are formed in at least 10% of the color domains.

2. The process according to claim 1, wherein, in each of the color domains, two or more of the halftone dots are applied alongside one another and/or over one another and/or overlapping one another on the first surface of the substrate.

3. The process according to claim 1, wherein the halftone dots have at least one lateral dimension in the range between 40 μm and 100 μm, wherein the lateral dimensions of the halftone dots amount to between two times and five times the lateral dimension of the effect pigments.

4. The process according to claim 1, wherein the substrate is selected from or components of the substrate are selected from the following: PET, PP, PE, PA, PEN.

5. The process according to claim 1, wherein the substrate is transparent, and the transparent substrate is applied, by a surface opposite to the first surface, to a colored background.

6. The process according to claim 1, wherein a protective layer is applied to the first surface and/or to the surface of the substrate that is opposite to the first surface, said protective layer being selected from the following: transparent overprint, laminate, plastic sheet, glass sheet.

7. The process according to claim 1, wherein the substrate is transparent, and the transparent substrate is applied, by the first surface, to a colored background.

8. The process according to claim 1, wherein the substrate is opaque and/or is applied to a black or dark surface.

9. The process according to claim 1, wherein the substrate has at least one colored varnish coat on a second surface that is opposite to the first surface.

10. The process according to claim 9, wherein a colorimetric value of the visible intrinsic color of the colored varnish coat in a color space defined by coordinate axes a* and b* specifying the complementary colors and by coordinate axis L* specifying the luminance of the hue in a CIELAB color space, is provided in a range of L* of greater than or equal to 0 and less than or equal to 90.

11. The process according to claim 9, wherein the colored varnish coat is provided with one or more dyes and/or one or more different-colored pigments.

12. The process according to claim 11, wherein one or more of the pigments are selected from the following: optically variable pigments, pigments containing thin-film layers and/or liquid-crystal layers which generate a color shift effect dependent on viewing angle or illumination angle, organic pigments, inorganic pigments, luminescent additives, UV-fluorescent additives, UV-phosphorescent additives, IR-phosphorescent additives, IR upconverters, thermochromic additives.

13. The process according to claim 11, wherein a pigmentation number of greater than or equal to 5 $cm^3/g$ and less than or equal to 120 $cm^3/g$, is provided.

14. The process according to claim 1, wherein a register tolerance in an advancement direction and/or perpendicular to the advancement direction between at least two regions, each of which is transferred or printed onto the substrate by different thermal transfer foils, to one another is greater than or equal to −0.15 mm and less than or equal to +0.15 mm.

15. The process according to claim 1, wherein a first of the thermal transfer foils comprises a red effect pigment layer, and wherein a second of the thermal transfer foils comprises a green effect pigment layer, and wherein a third of the thermal transfer foils comprises a blue effect pigment layer.

16. The process according to claim 1, wherein the thermal transfer foil has two or more regions in which the effect pigment layer comprises effect pigments which differ in respect of their color effect, and/or orientation.

17. The process according to claim 1, wherein the process comprises the following further steps:

providing a multicolored motif;

determining two or more grayscale images assigned in each case to a color channel; converting a third grayscale image assigned to a blue color channel;

converting the respective grayscale images into a respective halftone image consisting of a multiplicity of halftone dots, based on frequency-modulated rastering and/or on periodic rastering; and driving the thermal transfer printhead or of the thermal printheads in such a way that the subareas of the effect pigment layer or effect pigment layers, in halftone dot formation, are transferred to the first surface of the substrate in accordance with the size and disposition of the halftone dots of the halftone images.

18. The process according to claim 17, wherein the periodic rastering is provided with two or more different halftone angles and/or two or more different halftone dot shapes.

19. The process according to claim 1, wherein the halftone dot shapes are selected from the following: punctiform, rhomboidal, cruciform.

20. The process according to claim 17, wherein the multicolored motif is selected from the following: photos, images, alphanumeric symbols, logos, microtexts, portraits, pictograms.

21. The process according to claim 1, wherein the process comprises the following further steps:

applying further layers or layer sequences before and/or after the application of the true color image by means of a process selected from the following: thermal transfer printing, gravure printing, flexographic printing, screen printing, pad printing, inkjet printing, hot stamping, cold stamping.

22. The process according to claim 21, wherein the layers or layer sequences are each or partially selected from the following: transparent, translucent and/or opaque color layer, transparent, translucent and/or opaque metallic layer, open or embedded replication layer comprising diffractive and/or refractive relief structures, transparent, translucent and/or opaque reflection layer, thin metal layer, HRI layer, LRI layer, volume hologram layer, transparent, translucent and/or opaque thin-film construction, Fabry-Perot layer with absorption layer, spacer layer and/or reflection layer.

23. A true color image produced according to claim 1, wherein the true color image comprises a multiplicity of halftone dots applied to a first surface of a substrate, wherein the halftone dots are formed by subareas of an effect pigment layer of a thermal transfer foil or by subareas of effect pigment layers of two or more different thermal transfer foils.

24. The true color image according to claim 23, wherein a halftone dot comprises 10 to 1000 effect pigments, which are disposed partly or completely above one another and/or alongside one another.

* * * * *